US010851552B1

(12) United States Patent
DeMatteis et al.

(10) Patent No.: US 10,851,552 B1
(45) Date of Patent: Dec. 1, 2020

(54) PORTABLE PERSONAL USE MODULE AND METHODS OF USE

(71) Applicants: Robert DeMatteis, Grass Valley, CA (US); Robert Bowers, Jacksonville Beach, FL (US); Joseph Bowers, Jacksonville, FL (US)

(72) Inventors: Robert DeMatteis, Grass Valley, CA (US); Robert Bowers, Jacksonville Beach, FL (US); Joseph Bowers, Jacksonville, FL (US)

(73) Assignee: Cube Dynamics, LLC, Jacksonville, FL (US)

( * ) Notice: Subject to any disclaimer, the term of this patent is extended or adjusted under 35 U.S.C. 154(b) by 0 days.

(21) Appl. No.: 16/353,969

(22) Filed: Mar. 14, 2019

Related U.S. Application Data

(60) Provisional application No. 62/643,152, filed on Mar. 14, 2018.

(51) Int. Cl.
*E04H 1/00* (2006.01)
*E04H 1/12* (2006.01)

(52) U.S. Cl.
CPC ..... *E04H 1/1205* (2013.01); *E04H 1/1222* (2013.01)

(58) Field of Classification Search
CPC .... E04B 1/343; E04B 1/34336; B60P 1/6418; B65D 88/12; E04H 1/1205; E04H 2001/1283
See application file for complete search history.

(56) References Cited

U.S. PATENT DOCUMENTS 1,417,736 A * 5/1922 Heygate ..... E04B 1/34336 52/69
3,841,036 A * 10/1974 Johnson ..... E04B 1/34336 52/28
5,042,863 A 8/1991 Fraga
5,070,661 A * 12/1991 Lo Guidici ..... E04B 1/34336 52/220.1
5,285,604 A * 2/1994 Carlin ..... B60P 3/14 52/143
5,511,908 A * 4/1996 Van Valkenburgh ..... B65F 1/1426 206/386
6,357,550 B1 * 3/2002 Willson ..... E04H 1/1205 182/131
6,626,304 B1 9/2003 Corbett et al.
6,675,540 B1 * 1/2004 Rokes ..... E04B 1/34336 220/1.5
6,736,446 B1 5/2004 Johnson
7,497,347 B2 3/2009 Norris, Jr.
7,726,719 B1 6/2010 Barron
7,744,333 B2 6/2010 Chaddock
(Continued)

*Primary Examiner* — Gisele D Ford
(74) *Attorney, Agent, or Firm* — Advantage IP Law Firm

(57) ABSTRACT

A portable personal use module and related methods of use are generally disclosed herein with the portable structural unit having a set of amenities selected prior to the transport of the portable structural unit from an initial location to a designated usage location and subsequently used to customize the interior space at the designated usage location with the portable structural unit removably placed therein along with a command center in communication with at least one powered device from the set of amenities and operable to selectively grant control of the powered device to a user at the designated usage location.

15 Claims, 16 Drawing Sheets

(56) References Cited

U.S. PATENT DOCUMENTS 8,650,806 B1 * 2/2014 Condie ..... E04H 1/1205 52/79.5
8,919,285 B1 12/2014 Chambers
9,121,168 B2 * 9/2015 Levy ..... E04B 1/3483
9,181,048 B1 11/2015 Rash
9,936,596 B2 * 4/2018 Kamen ..... E04H 9/00
10,450,739 B1 * 10/2019 Schlagel ..... E04H 6/02
10,480,176 B2 * 11/2019 Unger ..... E04B 1/19
2003/0009954 A1 * 1/2003 Bradley ..... E04H 1/1205 52/79.1
2006/0185262 A1 * 8/2006 Abler ..... E04B 1/3442 52/64
2007/0163184 A1 * 7/2007 Olesch ..... E04B 1/34869 52/79.5
2009/0217600 A1 * 9/2009 De Azambuja ..... B60P 3/34 52/79.5
2011/0072735 A1 * 3/2011 Lupattelli ..... E04B 1/34815 52/79.5
2011/0094167 A1 * 4/2011 Noiseux ..... E04B 1/3444 52/79.5
2011/0214361 A1 * 9/2011 Ingjaldsdottir ..... E04H 1/00 52/79.1
2012/0110925 A1 * 5/2012 Weber ..... E04D 13/03 52/79.1
2014/0116870 A1 * 5/2014 Kamen ..... E04H 1/1222 202/83
2014/0157685 A1 * 6/2014 Fagan ..... E04B 1/3444 52/79.5
2014/0311051 A1 * 10/2014 Fagan ..... E04B 1/34384 52/79.5
2016/0059105 A1 * 3/2016 Scade Garcia ..... A63B 71/02 52/69
2017/0174452 A1 * 6/2017 Borntrager ..... B60P 1/435
2018/0163391 A1 * 6/2018 King ..... E04H 1/02
2019/0186163 A1 * 6/2019 Li ..... E04H 1/12
2019/0263314 A1 * 8/2019 Harada ..... E04B 1/003
2020/0032504 A1 * 1/2020 Song ..... E04H 1/12

* cited by examiner

PORTABLE PERSONAL USE MODULE AND METHODS OF USE

CROSS-REFERENCE TO OTHER APPLICATIONS

This application claims the benefit of U.S. Application No. 62/643,152, filed on Mar. 14, 2018, entitled Portable Module Delivery and Use Methodologies, which is hereby incorporated by reference in its entirety.

BACKGROUND

1. Field of the Invention

The present invention generally relates to coordinating transportation, freight and delivery services along with associated software, hardware, and control systems for automated and semi-automated delivery and use of portable module containers, and the containers themselves, that may be used for personal, commercial, industrial, or promotional uses.

2. Background Art

Portable container modules are commonly used in the storage and moving trade, for example, when a person moves from one residence to another. They are commonly referred to in the trade as "pods". A person or party moving as such, can call a moving company, such as those moving services offered under the trademarks PackRat or Pods. The moving company would typically drop off a storage pod at a first residence where the pod would be loaded with furnishings, personal items, equipment, and so on. After the pod is loaded, the pod is then locked, the customer calls the pod-moving company, the company picks up the locked pod, and ships the pod to a second residence. The customer may then unlock the pod and unload the contents into the new, second residence. Alternatives to this method may include putting the pod into storage for a time period, or using the pod for the transport of business equipment, goods, archival documents, and so on.

Shipping containers of the Pods brand variety are dropped off and picked up by a proprietary, outsized, upside-down U-shaped carrier that literally picks up the container, and looks and operates similar to that of a marine sling used in boat launches and boat yards to extract boats from the water. The primary difference being that the carrier uses four chains attached into a base frame near the Pod's four corners instead of the polyester marine slings used to extract a boat.

At times these portable containers may be used as temporary or long-term storage containers by businesses wanting additional storage, or as a more or less permanent structure to house business operations machinery and electronics, whereas the container may be attached to an electric source. In such a case the container storage pod may be stored in the businesses' general locale, a parking lot, near a shipping doc or elsewhere, until the container is no longer needed.

These storage pods and similar others are essentially empty containers, which may or may not have a finished interior, that are picked up by a crane loaded onto a truck, and transported to the desired location, and then picked up and placed as previously described. The containers may subsequently reshipped to a second destination located nearby, nationwide, or at times worldwide. A typical size of a small storage pod may be 7' wide by 7' tall, by 15' long.

An alternative storage and transport solution focusing more on personal comfort is a mobile home that has certain comfort and personal use amenities such as chairs, couches, cabinets to store kitchen items, refrigeration, and may have heating and air conditioning. It is well-known that mobile homes are generally set-up for long periods of time, for example as a residence, or perhaps a shorter time frame, such as a contractor's office at a new commercial construction site. These types of habitats have entry porches and doors similarly sized to those used in common, ordinary housing. The method of shipping and semi-permanently affixing mobile homes to a support foundation is also well-known. It typically uses a common block (or post and beam) construction with a cost that is much less than a permanent home foundation that uses concrete and rebar. Mobile home foundations require professional installation and can cost several thousand dollars for the beam supports and the labor to affix to the ground. It also takes significant time, sometimes days or weeks, to complete the foundation.

Two additional personal use storage and transport solutions are wheeled trailers and recreational vehicles (RVs), both of which may have the same comfort and personal use amenities such as chairs, couches, cabinets to store kitchen items, refrigeration, and at times heating and air conditioning. These trailers and vehicles tend to be expensive, in particular the RV vehicles, since they require a driving cab. A wheeled trailer also requires a suitable automobile or truck for transportation, which typically stays with the trailer when used for the short-term, such as on a vacation. In both of these examples, the transport vehicles generally consume much additional space for the RV cabs or the trailer/transporting automobile combination, and when parked in a parking lot or otherwise, require an elongated parking space. In both cases, there is typically at least one door for entry with exterior steps descending to the ground. These doors emulate those of everyday houses and dwellings, except may be somewhat smaller, depending on the size of the trailer or RV.

Should the aforementioned wheeled trailers and RVs with their human comfort amenities be rented on a temporary basis, the transaction generally requires a fairly extensive lead time and preparation on behalf of the renter and the requirement for the lessee to have a valid driver's license, applicable insurance, and usually be of a certain age. Younger people under 25 years generally cannot legally rent RVs. With a rental of a trailer, a vehicle with a suitable trailer hitch assembly and sufficient power is also required.

Other forms of containers focusing on comfort usage at various events, such as trade shows and local street markets, are provided in the form of modified shipping containers. These tend to be expensive for a custom build. For example, units such as those made by BoxLife™ cost in excess of $35,000 for a fairly basic customized unit. Those made by SteelSpace Concepts™ tend to be more elaborate and for commercial applications. A basic small container can cost well over $50,000-$100,000.

In addition, these cargo containers are usually wood or metal containers that are customized and generally sold to end user customers for a particular purpose. Once customized, the cargo containers are not generally suited for use by other customers as much of the customized selections are fixed in place. Thus, the likelihood of a resell to or subsequent use by customers with different customization preferences is questionable without additional significant and often expensive modification in many instances.

In addition, such containers are typically upcycled cargo containers with a steel frame and corrugated walls welded together and thus are limited to the basic cargo container shape. The walls, once welded together, are not constructed to break down without significant tear down efforts, most of which are destructive in nature. Such containers are typically hauled around on a flatbed trailer and set into place using a crane or may use extendible hydraulic jacks to offload the container from the flatbed trailer and lower the container into place and level. Such operation requires the flatbed trailer to be able to enter the exact location where the container is to be placed and then driven out from under the raised container. This requirement limits the allowable locations in which a container may be placed.

In the case of the containers sold under the SteelSpace Concepts brand, these are typically open on three ends and do not incorporate an area which may be sealed off and climate controlled. Units sold under the BoxLife brand commonly take advantage of the existing solid cargo doors to provide an entrance at one of the container and also cut out an enlarged section from one of the side walls to act as an awning or roof extension and provide a store front appearance and do not provide a sealed off interior either. These upcycled cargo storage containers also typically only provide a power on, power off function for any electronic devices provided but lack the more advanced technical means to selectively power on and control access to and use of the electronic devices that may be supplied with the unit either locally or remotely.

All of these other storage, transport, and venue based solutions are generally rented and sold through traditional methodologies that require substantial financial verifications such as credit reports, driver licenses, and so on. Many of the fixed units are cumbersome to load and unload and require proprietary lifts and slings, or the use of large commercial cranes. These time consuming containers and methodologies are expensive, require highly experienced personnel to operate, and are not practical for fast, easy placement.

In addition, common storage pods are simply not practical for uses that require people comfort or any form of sophisticated hook-up, which is desirable in most temporary and permanent installations. Pods are used to secure stored goods and protect them against the elements. Thus, their basic structural requirement is simple, functional, to do exactly that. Ordinary pods would be impractical for human comfort applications from the very perspective that no human comfort attributes are built in.

On the other hand, a portable pod/container specifically designed and engineered for human comforts and ease of use and can serve as a means to provide hospitality, commercial operations, and exposure, or even entertainment, that overcomes the numerous problems and short-comings associated with these other solutions would be valuable to these trades and many others. Thus, given many of the drawbacks of these other solutions, there exists a need for an portable personal use module that may be customized toward a customer, event, or venue with more advanced device control technology along with simpler methods of transporting, setting up, breaking down, and using such modules.

SUMMARY

In accordance with the principles of the present invention, one exemplary embodiment of a portable personal use module may be provided as a portable structural unit including a support base framework section with at least one set of spaced apart forklift receiving slots, a set of upright wall sections projecting upwardly from the support base framework section with at least one wall defining at least one entryway, and a roof section mounted atop the upright wall sections with the sections cooperating to define an enclosable interior space accessible through the entryway and further comprising a set of amenities selected prior to the transport of the portable structural unit from an initial location to a designated usage location and constructed to customize the interior space of the portable structural unit at the designated usage location with the portable structural unit removably placed therein, the set of amenities including at least one powered device with at least one control restriction along with a command center in communication with the at least one powered device and operable to selectively grant control of the at least one powered device to a user at the designated usage location.

The portable module delivery and use methodologies provided in accordance with the principles of the present invention are offered to overcome the drawbacks associated with other prior approaches. The portable personal use modules (PUMs) and related methodologies disclosed herein allow users and businesses to efficaciously secure and use the PUM for a variety of non-storage-only, temporarily- and permanent-related purposes, including hospitality, entertainment, commercial and business use applications, and so on. More so, the PUM securely, economically, quickly, and efficiently accomplishes one or more of the desired objectives set forth below. An example of such a portable module is described herein, whereas a renter, purchaser or user of the PUM does not require a vehicle, a driver's license, insurance, and generally has a lower age requirement for use. Since the method of delivery requires no foundation, just a common, ordinary parking space or the equivalent, the PUM may be dropped off for immediate use. The PUM allows users to use any form of monetary credit or cash means to immediately order and have the PUM sent from an original storage location (OSL) to a desired usage location (DUL), where the unit may be set-up in a matter of minutes, often as quickly as thirty minutes or less.

The PUM as described herein is only one example of use with the preferred embodiments and reveals a unique structure that requires no proprietary lifts, marine-slings apparatuses, or cranes, only a suitable forklift to offload and place. The PUM may be plugged into a local or portable electrical grid and put into operation by the simple flip of a switch. Furthermore, unlike the specialty Pods brand containers and crane-delivered containers, the versatility of the PUM structure may allow forklift access to all sides, making placement and further adjustment (leveling, spacing, etc.) quick and easy.

The PUM used in the methodologies as described herein is typically delivered with a preferred, pre-determined, pre-selected inventory of human comfort embodiments and amenities, which delivery may be made by a first-, second-, or third-party entity, or other the designated delivery service (DDS) to the DUL. The DDS ships the PUM and off-loads the PUM at the DUL and then sets up the PUM ready for use, typically in minutes. Upon a specified end of use by the customer, either pre-scheduled, or subsequently requested, the DDS then returns to pick up the PUM and returns the PUM to its OSL. The storage location may be any number of sites including those used by the DDS, an associate sales/rental entity, a third-party storage location, or a site operated by the DUL.

Off-loading of a PUM from a DDS truck, or placement at a DUL, is typically accomplished by any type of forklift adequate load capacity, or a remote controlled means such as a remote controlled mule vehicle or other remote controlled transport or autopilot transport system, which may be housed on the same delivery truck or one located at the DUL site. The DDS may also include a self-contained, or detached, self-driving means, and may be remotely operated. A DDS truck or the delivery means may or may not be of a sufficient size to optionally deliver and off-load more than one PUM should it wish.

Additional benefits disclosed herein include the significant ease of use and operation for an end user consumer. This includes no requirement to have a foundation, no steps required to enter a ground floor, no ownership requirement, no need to own or rent a truck with a trailer hitch, no need to have a driver's license, no legal age requirement, no clean-up afterward, no pick up or storage after use, and so on. Likewise, the PUM incorporates the many advantages of the ease for second- and third-party DDSs who own and rent the PUMs, which include placing a PUM in a DUL and easily, quickly setting the PUM up for use; locating and picking the PUM up afterward, and easily breaking down and closing the PUM. The PUM related methods include storing the PUM in a desirable offsite or DUL onsite location, stacking multiple PUM units, and so on. The PUM related methods also include the ease of renting a PUM through a simple cash or credit transaction, through an electronic transaction such as the internet, smart phone, tablet, or self-service kiosk, and; by phone, in person, and so on. Overall, the time savings and ease of use for end users are substantial.

The methodologies of use may also include the use of a command center within the PUM that may alternately be operated locally or remotely. For example, a command center affixed to a PUM may be operated through an intern network, or may connect (for example via Bluetooth, Wi-Fi, or satellite, or a combination thereof) to an authorized program or app such as one installed on a smart phone or tablet. The potential provides unlimited usages, including operation and control of all internal electronics, media, and electrical operations; GPS location finding, orders to return the PUM to its OSL, security issues and threats, and so on.

The Command center may also provide for the owner-operator desired information such as the location of the PUM, monitoring use and inventory, security and safety, to schedule pick up, etc. The delivery DDS driver may quickly locate and track the unit, know where to deliver the PUM, which is particularly helpful when the DUL is in a large parking lot, area, or remote location. For an end user or visitor, the command center with a location feature also makes the unit easy to locate, knowing where to send invitees so they can easily find the PUM, for example via a GPS positioning function, and; serves as a means to instantly control TV monitors, music, climate control, and so on. The command center may also provide valuable information regarding end user usage, experience, even a quick start guide. The functions disclosed herein are not intended to be limited solely to the functions cited herein, nor is it to be limited to only one command center operating system, but perhaps two or more, depending on the application.

Furthermore, the methodologies of use are greatly expanded by the PUMs portability and flexibility of use. For example, PUMs may be purchased by a stadium or authorized entity and rented/leased, sub-leased and so on, over the course of one or more specific designated schedules (like during the football season) and subsequently used for public, private, or invitation-only purposes. In such a case, it may be for profit, not-for-profit, promotional or private usage. In doing so, PUMs may be incorporated into a village of several units by its owner or lessee/renter, end user(s) and fenced or left unfenced depending upon the nature of its privacy and profit motive. One particularly desirable placement example may be to locate PUMs on a golf course, near the greens on a PGA® golf course. PUM owners may obviously use the unit(s) at their discretion, whether solely for personal use or for the alternate enjoyment of others, regardless of profit or not-for-profit motivation. It is not the intention of the business methodologies of use cited herein to be limited to how an owner wishes to use its PUM.

An alternate example is the use of PUMs at tradeshows. The owner may be the convention center, and may wish to rent/lease the units to the entity holding the tradeshow, or rent/lease them itself. The PUMs may also be used as information booths, rest stops, and so on, for its own internal use. The PUMs may be stored offsite in remote locations, local or afar, and are delivered to the convention center by their external owner. In any case, the PUMs may be owned by the remote OSL owner, the sponsor of the show, or by the tradeshow participants themselves, whereas the participant arranges for delivery and pick-up delivery, and subsequent shipping to a subsequent tradeshow locations. The flexible portability and speed of putting into use provides a highly desirable alternative to tradeshow booths made up of folding partitions, portable furnishings, carpeting, tents, signage, etc.

The methodologies of use by owners, users, renters, and so on become creatively viable depending on motive, whether that is solely for personal use or sharing, for profit, not-for-profit, and regardless of whether they are leased, rented, subleased, donated, and so on.

An exemplary set of objectives that may be provided by embodiments constructed in accordance with the principles of the present invention, include, but are not limited to:

1) A portable PUM that may be sold, or rented, leased, or subleased;
2) A portable PUM that may be used by one or more users;
3) A portable PUM that may be used for personal use, or business applications;
4) A portable PUM that may be used for profit or non-profit purposes;
5) A portable PUM that may be delivered by a second- or third-party source;
6) A portable PUM that may be set up in a matter of minutes;
7) A portable PUM that requires no foundation and may be easily put into use;
8) A portable PUM that may be temporarily or permanently stored offsite or onsite;
9) A portable PUM that may be temporarily or permanently used onsite;
10) A portable PUM that may be temporarily or permanently rented;
11) A portable PUM that may be sold, leased, or sub-leased for the purpose of earning profit or solely for personal comfort and convenience;
12) A portable PUM that may be sold, leased, or sub-leased, whereas the intention is to garner profit though an admission fee;
13) A portable PUM that may be sold, leased, or sub-leased for the purpose of receiving donations;
14) A portable PUM that may be sold, leased, or sub-leased for the purpose of fund raising;
15) A portable PUM that may be used in one or more commercial uses including but limited to stadium tailgate purposes, tradeshows, parties, catering, weight training, strength training, promotional activities, and so on;

16) A portable PUM that may be used in one or more temporary or permanent business applications including but limited to storage, machinery or electronic usages, and so on;
17) A methodology of an owner, or user, renting, leasing or subleasing a PUM for temporary use;
18) A methodology of an owner, or user, renting, leasing or subleasing a PUM for seasonal or part-time use;
19) A methodology of an owner, or user, renting, leasing or subleasing a PUM for use in one or more venues;
20) A methodology of an owner, or user, renting, leasing or subleasing a PUM for use in one or more venues during a season or part-time;
21) A methodology of an owner, or user, renting, leasing or subleasing a PUM for use in one or more locations;
22) A methodology of an owner, or user, renting, leasing or subleasing a PUM for the purpose of receiving donations, or fundraising, either directly or indirectly;
23) A methodology of an owner, or user, renting, leasing or subleasing a PUM to a third party entity for the third party's profit motives;
24) A methodology of an owner, or user, renting, leasing or subleasing a PUM to a third party entity for the third party's non-profit motives;
25) A methodology of an owner, or user, renting, leasing or subleasing a PUM to a third party entity for the third party's personal use motives;
26) A methodology of an owner, or user, renting, leasing or subleasing a PUM to a third party entity for the third party's promotional motives;
27) A methodology of an owner, or user, renting, leasing or subleasing a PUM to a third party entity for the third party's promotional motives including fund-raising or to receive donations;
28) A methodology of using a PUM for temporary purposes;
29) A methodology of using a PUM for personal use;
30) A methodology of using a PUM for commercial or business use;
31) A methodology of using a PUM that employs an internal command center;
32) A methodology of using a PUM that employs a remote command center;
33) A methodology of using a PUM that employs a GPS system to find its location;
34) A methodology of using a PUM by purchasing the right of use;
35) A methodology of using a PUM by paying an entry fee;
36) A methodology of renting the use of a PUM via a remote means;
37) A methodology of renting a PUM by arranging its use via one or more remote electronic, internet, or other communication means;
38) A methodology of tracking the use of a PUM via a remote means;
39) A methodology of tracking the use and/or location of a PUM through the use of one or more remote electronic, internet, or other communication means;
40) A methodology of tracking the use of a PUM via electronic storage in its command center;
41) A methodology of an owner, renter, lessee, sub-lessee, controlling the use of PUMs at a specific location for commercial or personal use, for profit or for non-profit, by exclusively authorizing or allowing solely the owner's, lessee's, sub-lessee's PUMs to be available for use/rental/admission/and so on, as desired;
42) The assembly of multiple PUMs in the form of a village;
43) The assembly of multiple PUMs in the form of a village used for private profit, or non-profit purposes; and/or
44) The assembly of multiple PUMs in the form of a village used for commercial or business purposes.

Furthermore, it is an object of this application to broadly illustrate the preferred embodiments constructed in accordance with the principles of the present invention and the sales, renting, leasing and use methodologies that may be employed in order to meet the multitude of unique business and use methodologies described herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION

A. Description of an Exemplary PUM

Figure 1A:
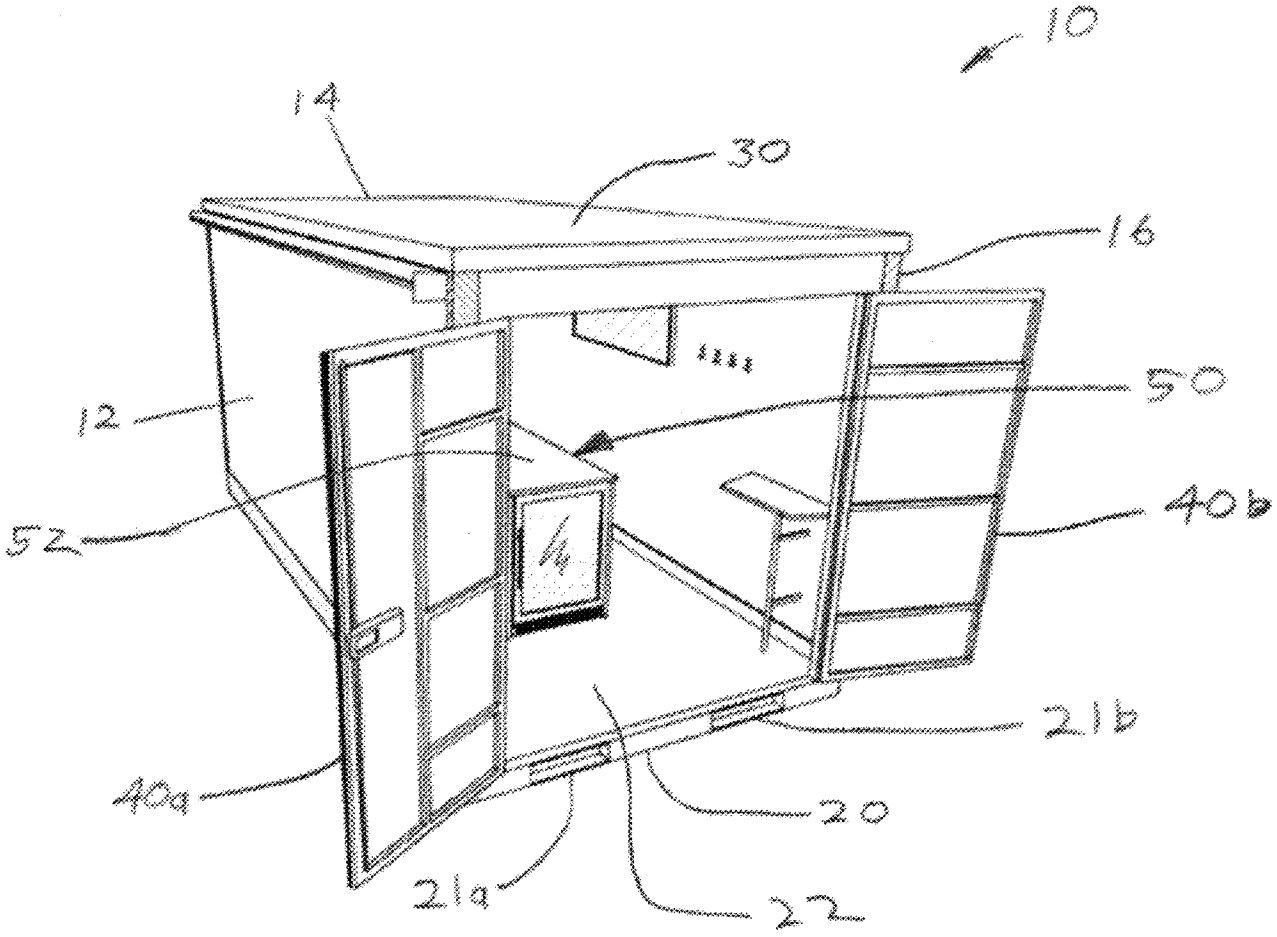
FIG. 1A is a perspective view of a first embodiment of a personal use module (PUM) constructed in accordance with the principles of the present invention and illustrating a retracted awning and doors in an open configuration showing a partial interior space.
Figure 1B:
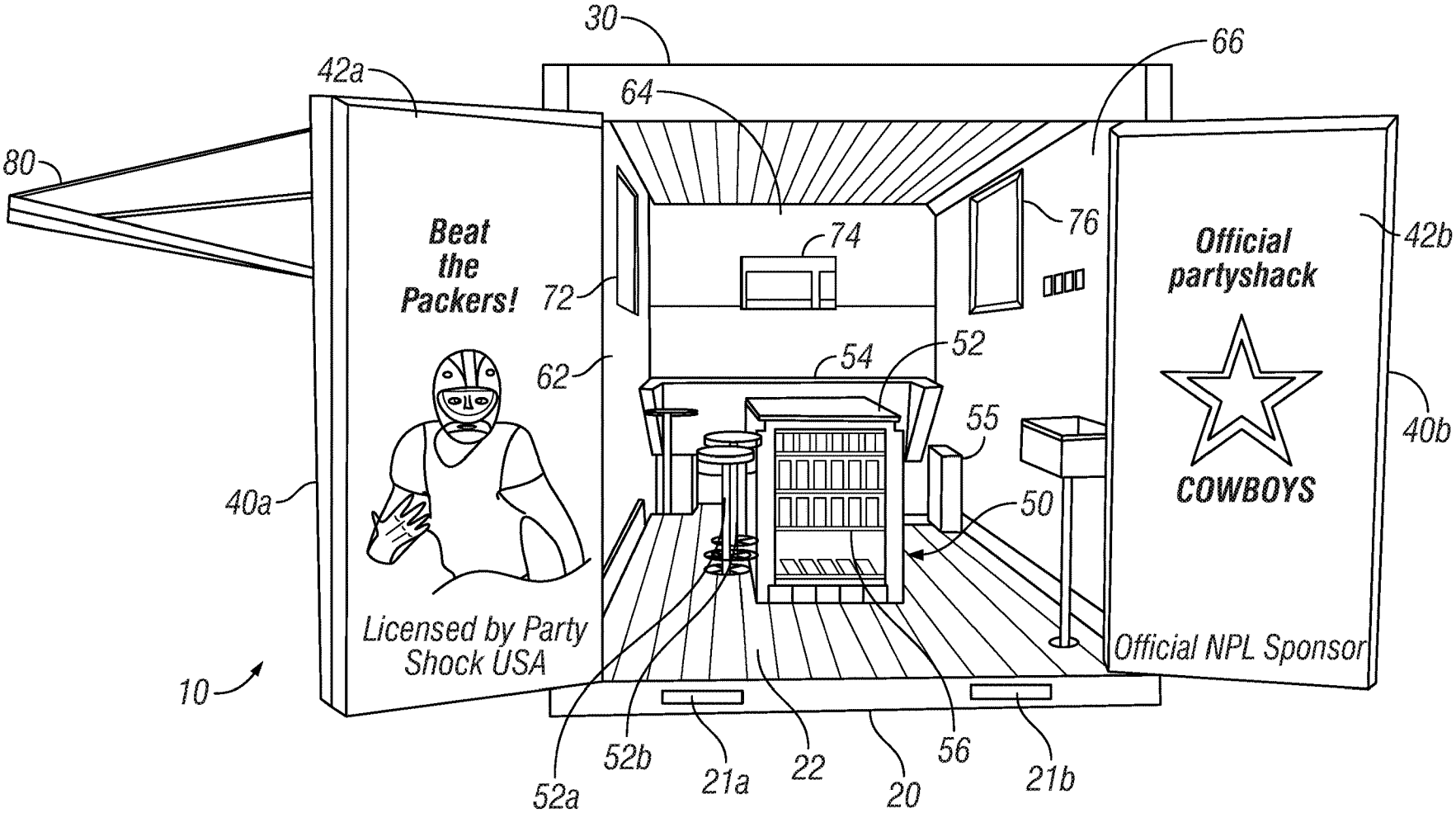
FIG. 1B is a perspective view of the PUM of FIG. 1 with an extended awning and a number of amenities set up for use.

In general terms, one or more embodiments described herein and constructed in accordance with principles of the present invention may be provided in the form of a portable personal use module (PUM), generally designated 10, as illustrated in FIGS. 1A-1B. In FIGS. 1A and 1B, the first embodiment of a portable PUM 10 used in the business and use methodologies disclosed herein and in accordance with the principles of the present invention, is typically a hexagonal or cubic structure with parallel opposing sides including a left side 12, a rear side 14, a right side 16, a bottom 20, a top 30, as well as a set of front doors 40*a* and 40*b* cooperating to close off at least one end of the module and provide access to an interior space defined by the side, bottom, and top sections. The sections cooperate to define an integrally structural unit when assembled together and may be lifted as a single unit. The bottom 20 is a structure that serves as a support base framework for the PUM 10 and includes a set of two spaced apart forklift receiving slots 21*a* and 21*b* that allow a forklift to insert its forks and transport the structural unit as desired. In this exemplary embodiment, there are typically three additional sets of spaced apart forklift receiving slots on the two sides 12 and 16, and the rear side 14, all of which provide optional access from each side of the cube for a forklift to transport, move, and shift the PUM as may be desired.

Figure 1C:
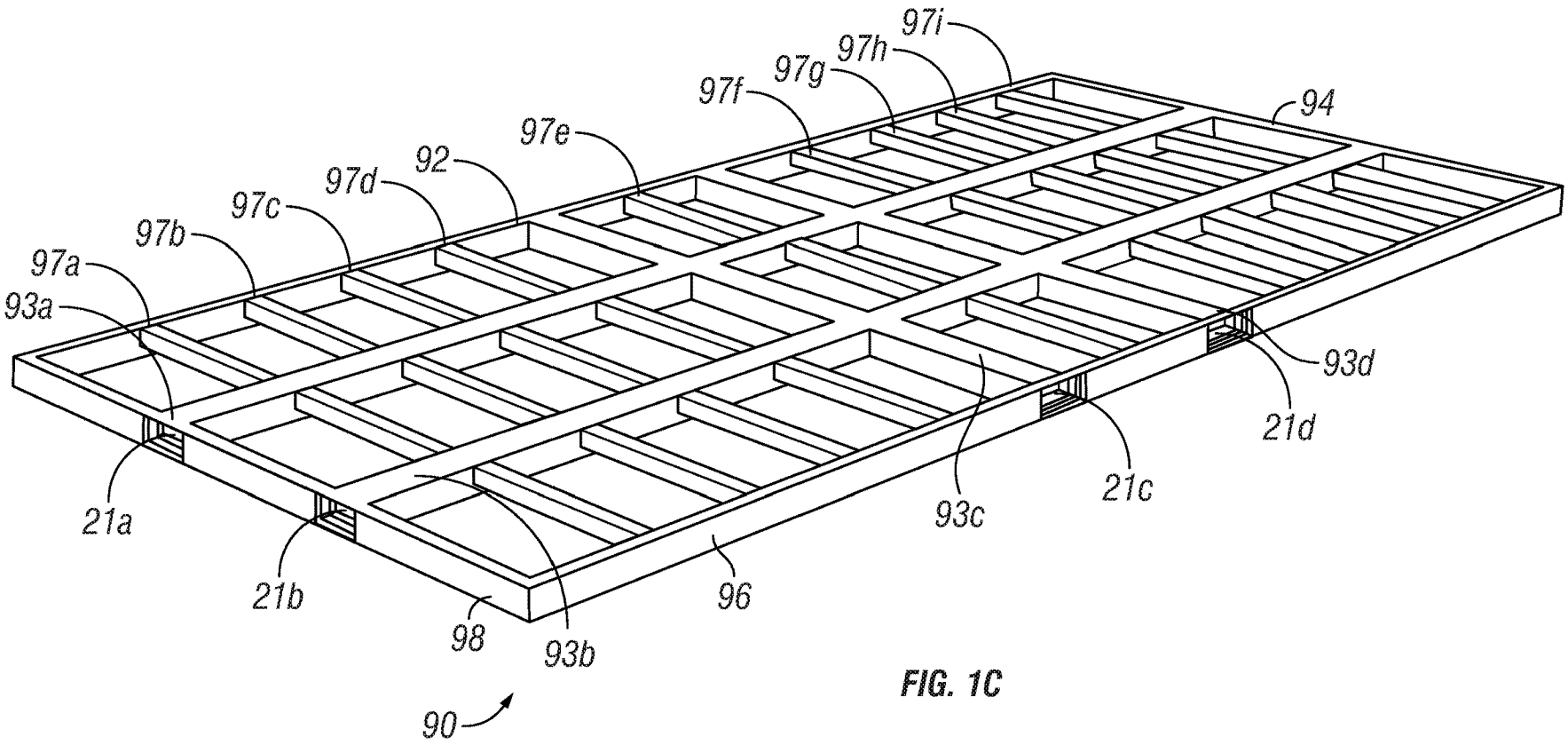
FIG. 1C is a perspective view of an exemplary bottom support base framework constructed in accordance with the principles of the present invention that may be used with the PUMs disclosed herein.
Figure 1D:
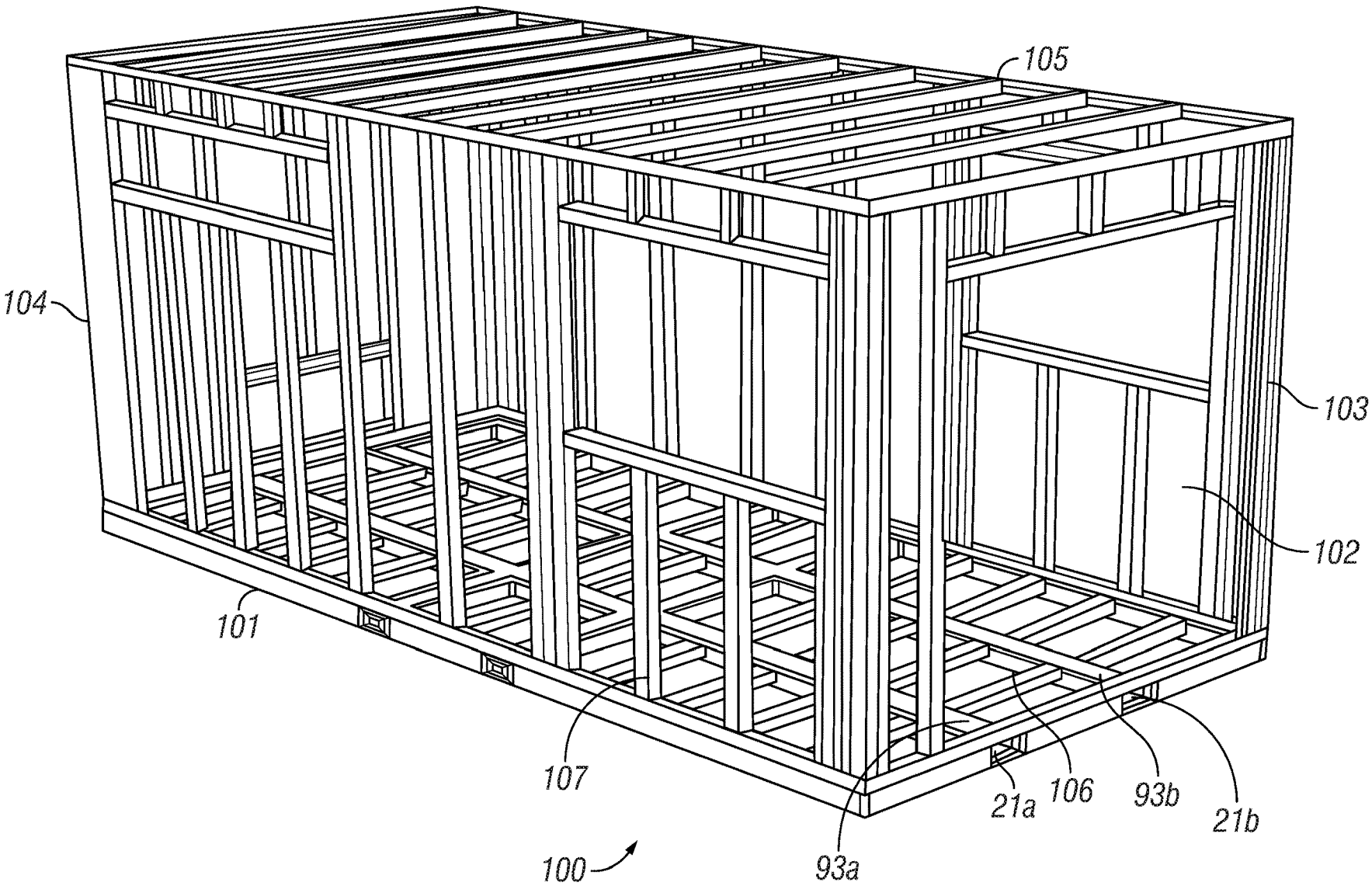
FIG. 1D is a perspective view of an exemplary assembled support cage constructed in accordance with the principles of the present invention that may be used as a frame for the PUMs disclosed herein.
Figure 1E:
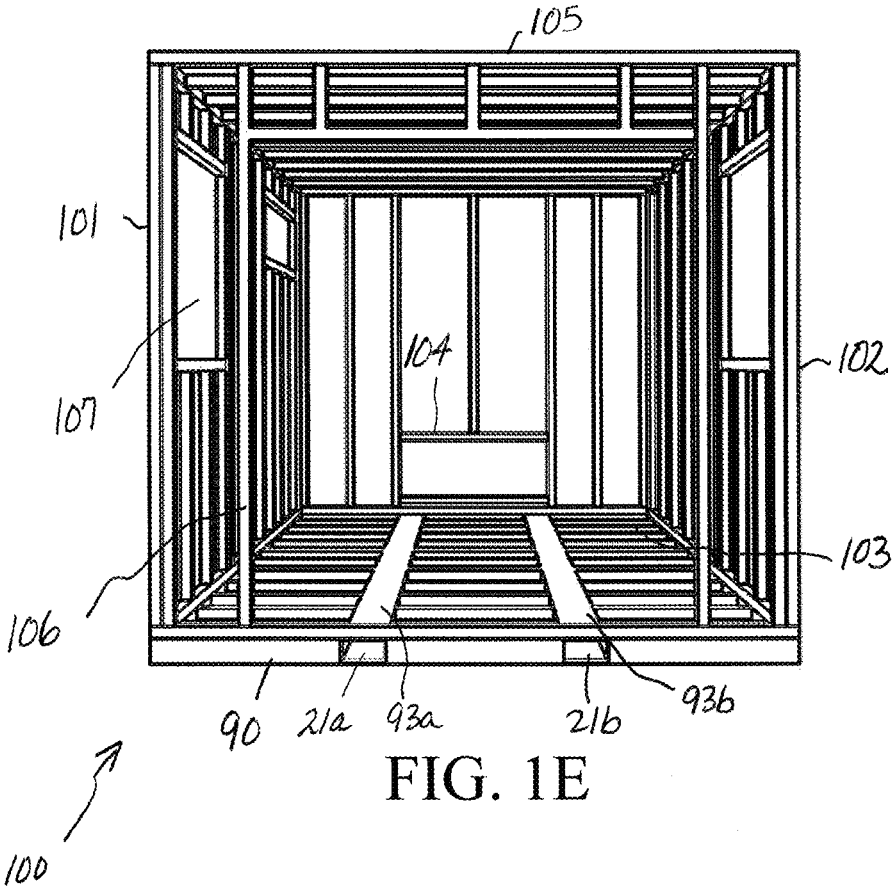
FIG. 1E is a front door end view of the support cage of FIG. 1D.
Figure 1F:
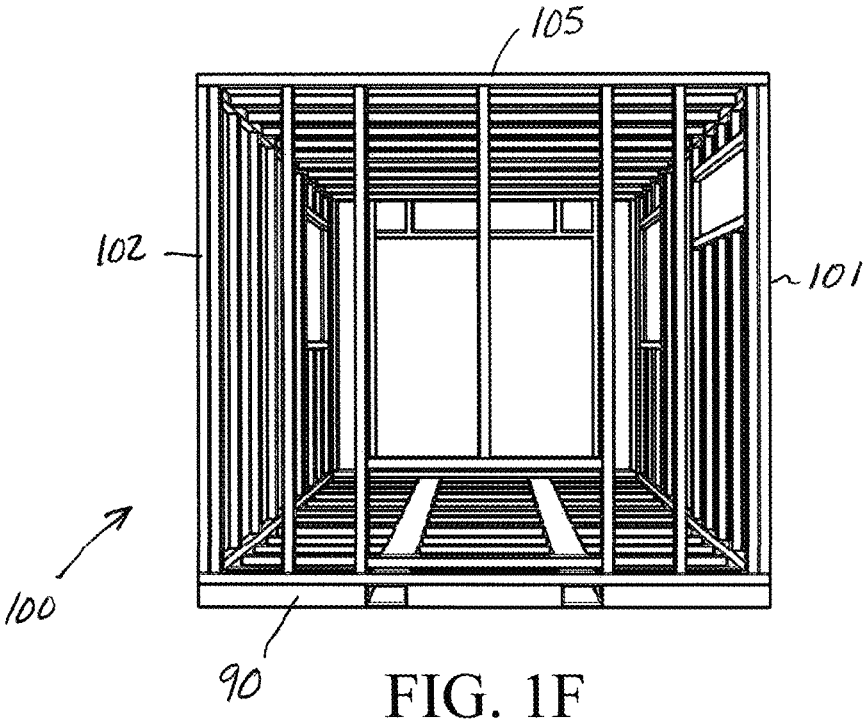
FIG. 1F is a rear end view of the support cage of FIG. 1D.
Figure 1G:
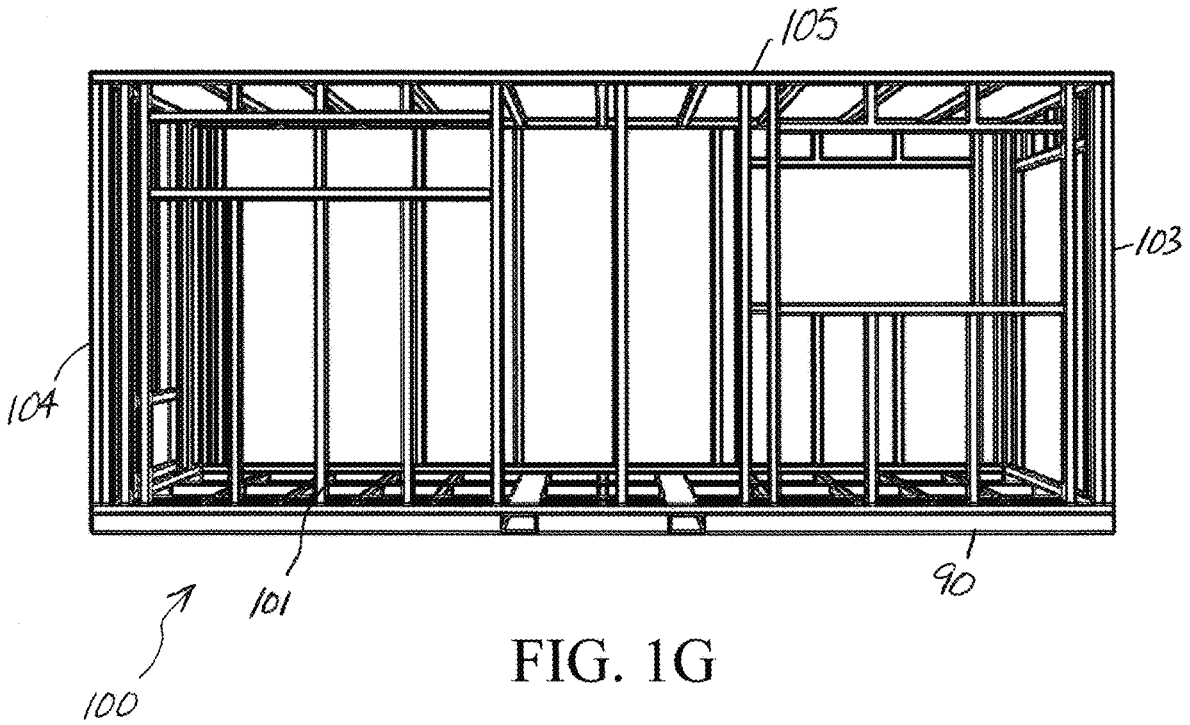
FIG. 1G is a left side view of the support cage of FIG. 1D.
Figure 1H:
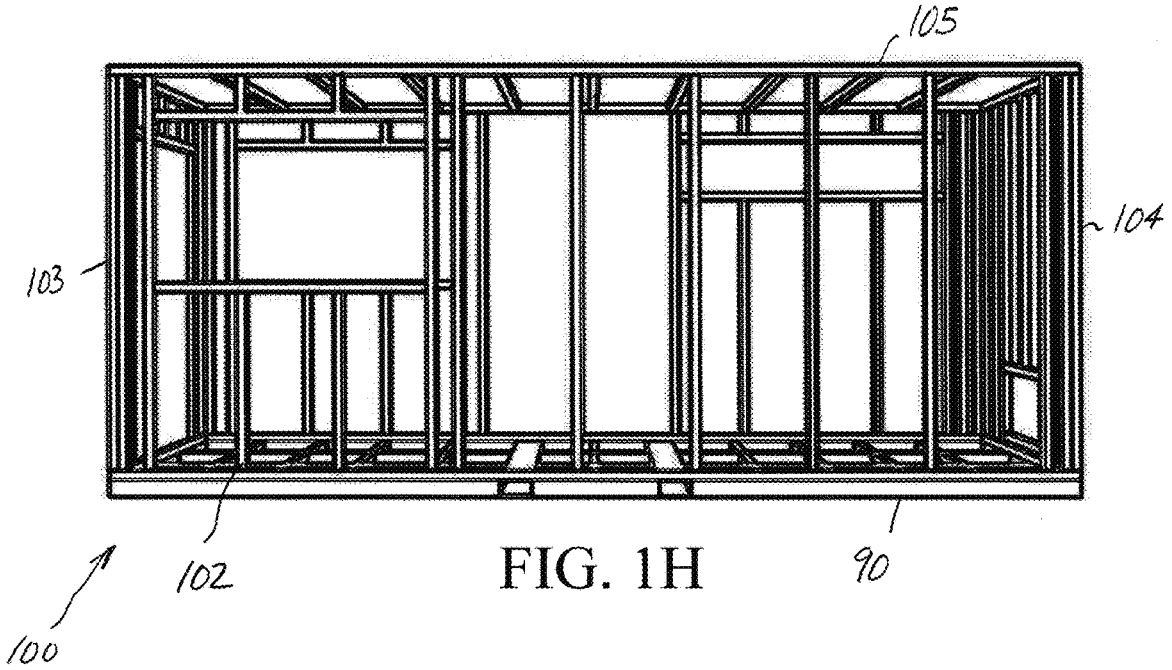
FIG. 1H is a right side view of the support cage of FIG. 1D.

Referring now to FIG. 1C, a rectangular, generally planar, support base framework section 90 forming the bottom 20 of the PUM 10 consists of four elongated girders including a left girder 92, a rear girder 94, a right girder 96, and a front girder 98 with the left and right girders having a greater length than the front and rear girders. The elongated girders generally define the base footprint of the PUM 10 and are preferably constructed of structural steel tubing, vertically disposed (narrow width facing up) and in a common plane, with further structural integrity introduced by a network of additional girders, crossbeams, and/or support tubes welded within as further described herein.

Still referring to FIG. 1C, two horizontal (transversely projecting) structural steel tubes 93*c* and 93*d* disposed in a flat disposition, span the entire width of framework 90, and are securely welded to left side girder 92 and right side girder 96 in a central location to provide a structural and weight load balance when PUM 10 is transported. The open ends of spaced apart structural steel tubes 93*c* and 93*d* are of sufficient size to comprise forklift slots 21*c* and 21*d* that allow a forklift to securely insert its forks inside to pick up, transport, and accurately place the PUM as desired. As illustrated, forklift receiving slots 21*a* and 21*b* are the open ends of two, spaced apart, elongated, longitudinally projecting, steel tubes 93*a* and 93*b* respectfully, and sized the same or similar to steel tubes 93*c* and 93*d*, and are welded to front girder 98 and to steel tube 93*c*. In this exemplary embodiment, the rear girder 94 and adjacent structural network are constructed the same as front girder 98 and its network described above.

With continued reference to FIG. 1C, in this exemplary embodiment, there are also nine spaced apart projecting crossbeams 97*a-i* made from structural steel tubing and positioned in a vertical disposition to further reinforce the PUM structure for lifting and subsequent stacking. Four crossbeams 97*a-d* appear in the front section between the front girder 98 and the fore forklift receiving tube 93*c*, one crossbeam 97*e* is disposed between the fore forklift receiving tube 93*c* and the aft forklift receiving tube 93*d*, and four spaced apart crossbeams are located between the aft forklift receiving tube 93*d* and the rear girder 94 providing an even distribution throughout the framework. The crossbeams 97*a-i* extend transversely from the left side girder 92 to the right side girder 96 and may be welded atop or below the longitudinal beams 93*a*, 93*b* or, alternatively, be constructed of shorter segments spanning the width of the frame 90 with the forklift receiving tubes 93*a-b* interposed between adjacent segments. The crossbeams provide additional structural support and serve as a foundation to secure a flooring 22 (FIG. 1A). Altogether, the girders, crossbeams, and forklift receiving tubes form a unique structural base providing significant rigidity, with some flexibility, to effectively pick up, move, and stack a PUM. Preferred footprints range from 20'×20', 24'×16', and 30'×20' although these are not meant to be limiting in any manner and smaller and larger footprints are contemplated as well.

Forklift receiving structural steel tubes 93*a*, 93*b*, 93*c*, and 93*d* typically have inside dimensions of 7" W×4.5" H but may vary depending on the size/weight distribution of the PUM or the type of forklift used. Vertically disposed outer girders 92, 94, 96, and 98 typically measure about 2"×5" for the PUM described in FIGS. 1A, 1B, and 1C. However, these dimensions may also vary depending on the size of the PUM. Crossbeams 97*a-i* are typically made from steel tubing about 2" square but may be sized according to the desired load. Such crossbeams may also be disposed in a vertical disposition to even further reinforce the base structure of the PUM.

Referring now to FIGS. 1D-1G, in addition to the base support framework section 90, the PUM 10 includes a structural support cage, generally designated 100, defined by a left side wall 101, a right side wall 102, a front wall 103, a rear wall 104, and a roof 105. Each section 101-105 of the cage includes a series of supports disposed in a common plane and welded together to form section modules. Each of the modules may be permanently affixed to adjacent sections by welding, bolts, rivets or other suitable means or left releasably attached to adjacent sections to facilitate a quicker module exchange process for replacement or customization purposes. The front wall 103 includes a door opening or entryway 106 from which to suspend a door or doors depending on the desired configuration. The left side wall includes at least one window opening 107 as does the right side wall. Together, when assembled, the bottom 90, left side wall 101, right side wall 102, front wall 103, rear wall 104, and roof 105 define the structural cage 100 that may be finished on the interior and exterior, accommodate electrical wiring and/or plumbing, and may be transported as a structural unit along with any finishing surfaces, wiring, plumbing, and amenities secured permanently or releaseably thereto as discussed below. The opposing upright wall sections 101, 102 and 103, 104, flooring section 90, roof section 105, and optional second level (FIGS. 8A-8D), may be made of metal, wood, plastic, or a combination therein.

Figure 6:
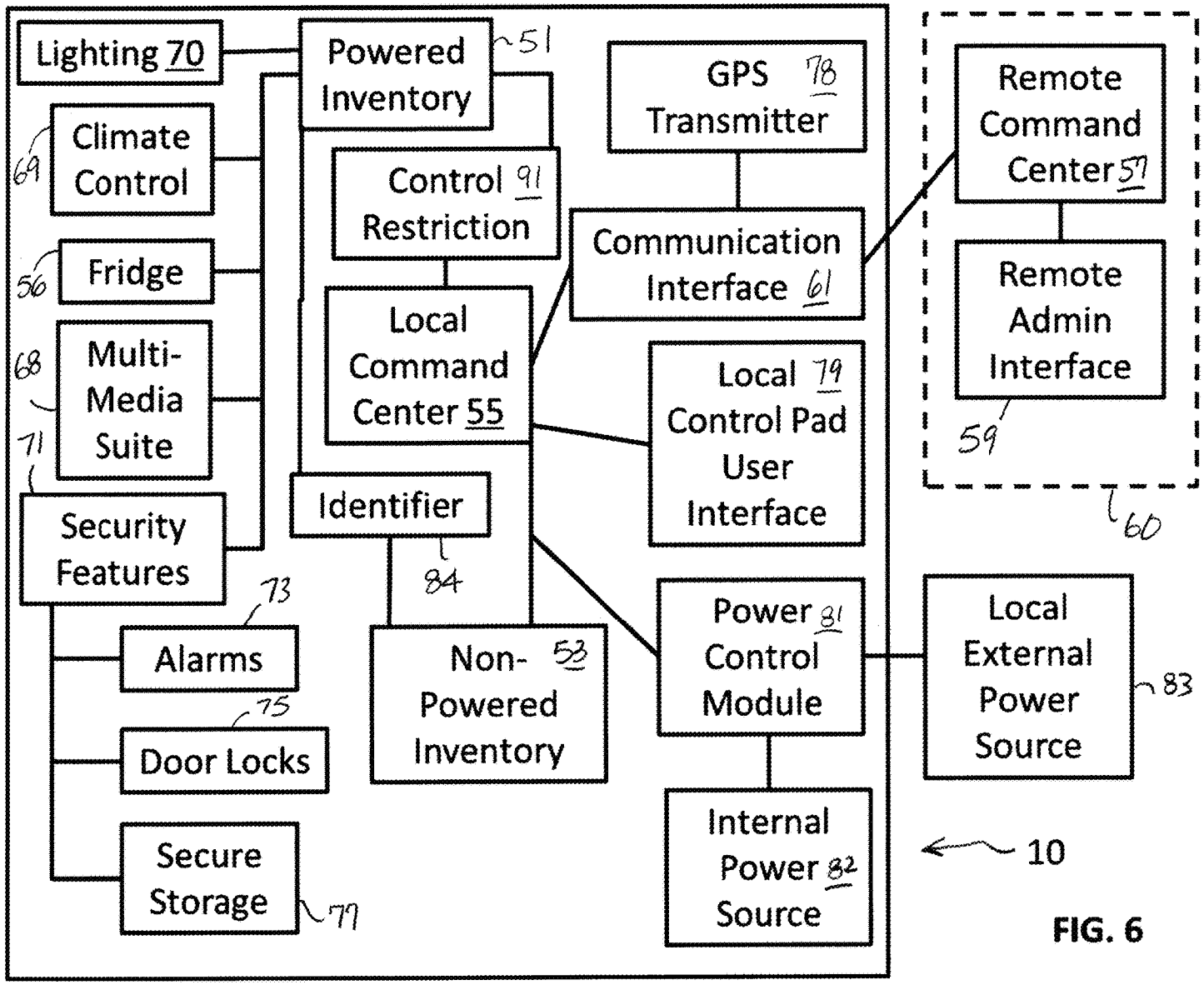
FIG. 6 is a schematic block diagram illustrating an exemplary amenity control system that may be used with a PUM.

Referring now to FIGS. 1A, 1B, and 6, the interior and exterior skin of the structural cage 100 (FIGS. 1D-1H) may be finished with materials such as vinyl flooring, paneling, and other suitable finishing materials to present a more pleasing appearance. In addition, each PUM 10 may be furnished with an inventory of one or more amenities or appurtenances used by humans and/or pets for one or more desired purposes, as, for example, personal comfort, entertainment, promotion, commerce, and so on. The inventory is typically divided into a powered (electronic) suite subset 68 which require a power source, whether internal or external, and a non-electronic (non-powered) suite subset 69 as shown in FIG. 6. Such inventory of amenities may be tailored or customized to the event where the use of the PUM 10 will take place.

One or more of the powered amenities 51 may include a control restriction 91 (FIG. 6) disabling access and/or use until such time as the control restriction is removed as described below. Control restrictions 91 may be in the form of physical and digital locks, lockboxes, lockouts, restricted lists or users, permissions, biometrics, face recognition password entry, access codes, and other suitable use restriction methods. Preferably the control restrictions may be removed remotely by the remote command center 57, with the local command center 55 by someone with authorized access, or provided over a communication network such as sending an access code via text to a user's mobile device or to the command center. One control restriction example would include a locked bar requiring a key code to open. Another would be a television requiring a code entered via remote control prior to use. A drawer may be locked with the television control locked inside requiring an access code to open the drawer and retrieve the remote control to use the television. The PUM may also be locked via a digital lock or lockbox in which case, the code may be provided by the command center, local or remote, to the user to gain entry. Such examples are merely meant to be illustrative and not limiting in any manner. In general, the command center, remote or local, may determine if a control restriction exists for each item of inventory which preferably have unique identifiers such as MAC addresses, bar codes, or other unique identifier, and then cooperate with user to remove one or more control restrictions depending on the amenities requested by the user. The control restrictions may be removed directly by the command center without further effort by the user or the control restriction removal codes may be provided to a user to remove the control restriction of associated amenities. Such control restrictions allow the PUM controller or administrator to selectively grant access and control to the amenities. Non-powered amenities may also be secured by a powered or otherwise restricted use amenity such as a locked cabinet housing utensils, glasses, or food along the lines of a hotel in room refrigerator or safe. Further details concerning such inventory of amenities 68, 69 follow.

With ongoing reference to FIGS. 1A-1B as illustrated, the top floor surface 22 of bottom 20 contains several such representative inventory amenities affixed (temporarily or permanently) to surface 22, including an island 50, a bar top 52, a seating area 54, and a refrigerator 56. Portably placed atop floor surface 22 adjacent bar top 52 are two bar stools 58*a* and 58*b*. Attached to inner surface 62 of left wall 12 is a flat screen TV 72, along inner surface 64 of rear wall 14 is air-conditioner/heater 74 and, on the flat inner surface 66 of right wall 16 is a promotional sign 76. On the inside surfaces of doors 40*a* and 40*b* are posters 42*a* and 42*b*, which in this particular example showing support for a favorite football team. Locations of the inventory of amenities or appurtenances are only representative of one configuration of many possibilities.

Adjacent seating area 54 is a command center 55 which may be used to interact with particular amenities 51, 53 and turn off/on the various electronic devices in the electronic suite 51 provided as a subset of the components and appurtenances used in the PUM 10, and to access and control, or surrender control to other peripheral electronic devices and services. For example, the various components and appurtenances in the electronic suite subset 51 of the inventory may include a multi-media suite 68 including flat screen TVs and audio systems, a refrigerator 56, climate control devices 69 such as an air conditioning and heating unit 74, or fans, lighting 71, security features 72 such as door locks 75, alarms 73, and secure storage 77 and so on. The control and/or surrender of control to peripheral devices 51 and services is typically controlled by the command module 55, either locally using a local control pad user interface 79 or from a remote location 60 having remote command center 57 and remote admin interface 59. Access and control may be granted using a password, control code, or other authorized access and control code or signal. The command module 55 uses a communication interface 61, which may include a GPS transmitter 78, with communication typically conducted via Wi-fi, Bluetooth, NFC, cellular, beaconing, cable, or other type of suitable wired or wireless telecommunication means including GPS, satellite, radio wave, etc. The GPS transmitter 78 may issue signals to GPS receiving devices of the party picking up the PUM 10, the end user or PUM controller, and other third party invitees to lock in a location of the PUM. The PUM would typically provide access to internet connections, a home base control center 60 at the OSL or other remote location, and any number of other free-standing devices, such as computers, tablets and smart phones owned by drivers, renters, users and visitors. Surrendering access to a remote device and/or service allows users to control all aspects of use of the PUM. For example, through a smart phone application, a single user may control temperature, audio volume and music playlists, TV channel selection, video play, slideshow presentations, starting up and locking up and closing the PUM, summoning a return to the OSL, an emergency request for help, and so on. It includes the use of GPS location-finding that may provide access to a number of guests and event participants, DDS employees, and a variety of other location-finding registration and positional purposes and usages.

The examples cited herein are considered representative of a small spectrum of potential uses and applications of the control center's ever expanding objectives. The command center 55 may also be placed in communication with a power control module 81 and the various electronic appurtenances 51 in a PUM 10 are generally powered on and off as determined by the power module 81 as powered by either by an external electrical source 83 (plug in outlet, battery powered, solar powered, or wirelessly/inductively charged source), or by an internal source 82, such as a battery powered, solar powered, or gas powered generator. The powered devices 51 may be powered by solar energy or any other effective method, and/or combination of two or more means.

PUM 10 may also be used for storage of certain non-electronic inventory 53 (FIG. 6) items such as glasses, kitchen utensils, towels, etc., which items subsequently may be put into use when PUM 10 is delivered to a desired location and put into operation by a user. Both powered inventory 51 and non-powered inventory 53 may also have unique identifiers 84 which may be maintained within the command module 55 to assist with tracking and inventory controls. A user may access the command center interface 79, which may be a local interface or the user's own mobile device. With the interface, the user may review the inventory list to determine which amenities 51, 53 are present and compare with the order. On the other hand, the administrator may compare the inventory listing with the actual inventory when picking up the PUM to determine if anything is missing. Copies of the inventory may be maintained at both the local command center 55 and the remote command center 57. It will be appreciated that promotional items, such as signage, may fall into the powered inventory 51 or non-powered inventory 53 category. For example, an electronic sign falls under powered inventory while a poster falls under non-powered inventory.

As illustrated in FIGS. 1A-1B, and 6, the PUM 10 typically has a finished interior and an inventory of amenities 51, 53 for human comfort. This is completely unlike typical storage pods used in the moving and storage trade.

Figure 7:
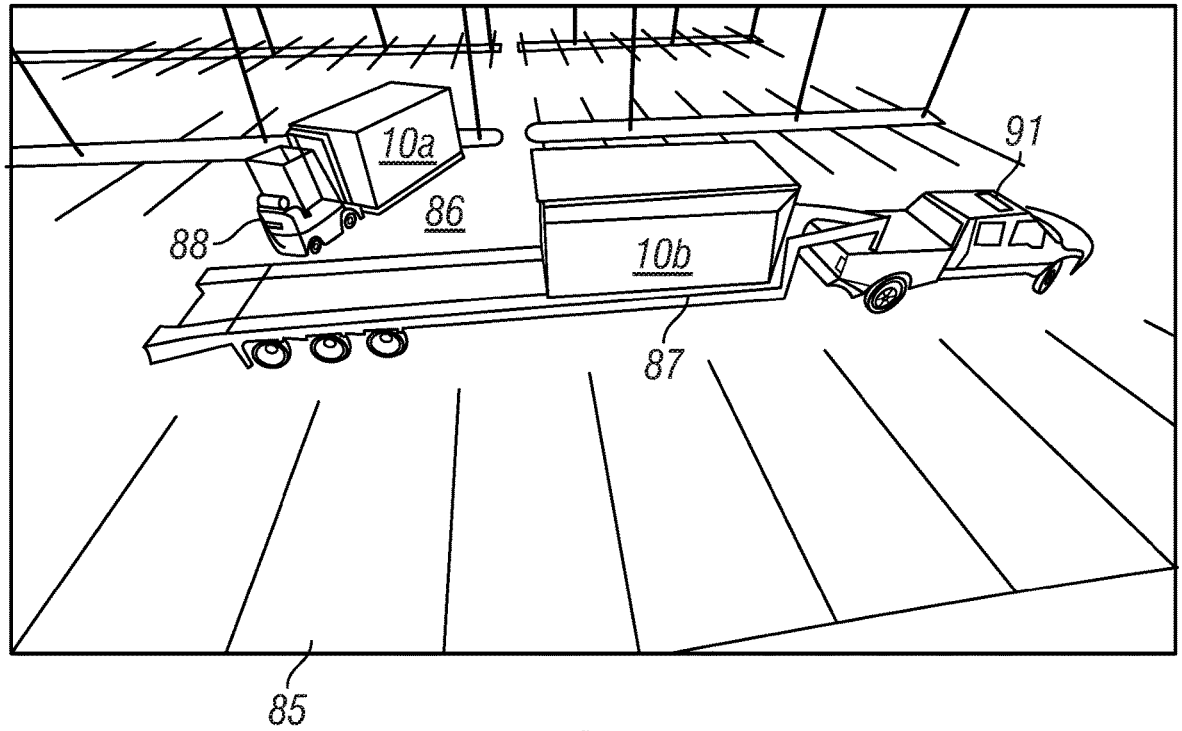
FIG. 7 is a schematic of a designated delivery service (DDS) depicting a PUM being offloaded at a designated usage location (DUL) with a forklift.

As for PUM placement and use as shown in FIG. 7, the PUM requires no permanent foundation to which the PUM must be fixed and instead merely needs an underlying support surface such as a parking lot 85 with a designated usage location (DUL) 86 into which a flatbed trailer 87 with one or more PUMs 10*a*, 10*b* and pulled by a truck 91 may approximately approach and with room for a forklift 88 to maneuver. Other suitable support surfaces include a trade show floor, tarmac, infield, cement base, or a solid ice, packed sand, or grass area, although these are not meant to be limiting as any relatively set or settled surface will do. Thus, the PUM avoids the issues presented with more permanent fixed foundation structures such as mobile homes. The use of a forklift 88 for loading and offloading the PUM allows for precise placement in an exact location as well. In addition, the PUMs 10 are structurally sound and may be stacked one atop one another whereas the top PUM may be used as a second floor, accessible by an adjacent stairway. The basic structure of PUM 10 requires no permanent foundation, typically requires no stairway for entry, and no mobile accoutrements, attachments, or peripherals such as wheels that would be used for road transportation, such as that of a trailer or mobile home. PUM 10 may be enhanced by the use of an awning 80, umbrellas, patio table and chairs, side-openings, windows, and so on. The intention in the business and use methodologies cited herein is sole representative of the object that referred to in said methodologies. Furthermore, the methodologies revealed herein are significantly enhanced when PUMs are mass-manufactured (as opposed to solely custom units), ideally of a module design that promotes a versatile designs and quick-change attributes.

PUM 10 and other varieties constructed in accordance with the principles of the present invention may be manufactured in a specific manner that meets ISO shipping standards and allows maximum flexibility to add, change, and modify components as desired. The process typically begins with the construction of support base framework (FIG. 1C) and subsequent construction/assembly of the two side, rear and front wall components. The wall components or sections are preferably one of various modules that are releasably or permanently attached to the support base framework. Wall modules consist of solid wall sections, a section with a window, a door (sliding glass or otherwise), and a section for attaching climate control systems, ACs, electrical power connections, and so on. Similarly the roof component or roof section is releasably or permanently attached to finish assembly. This structural assembly sequence provides the next steps to wire and insulate the PUM to meet NEC and UBC (Universal Building Code) standards if desired. This is entirely unlike present shipping containers that are retro-fitted, or portable fold-up type structures that meet few, if any United States codes. It is important to note that there are very few, if any, code requirements for portable structures used in tailgating, spectator events, tradeshows, street fairs, etc., whereas the PUMs disclosed herein may be designed to meet all such codes, including those of fire marshals who review event locations and participating structures and booths. In doing so, the PUMs may meet most known code requirements in anticipation of rising safety concerns that will spark intervening government regulation. Once the cube-shaped PUM is constructed in accordance to ISO and the above standards, an optional upper story may be added, with a portable staircase along one of the sides. After the interior is finished, the PUM is picked up by a forklift, transported to a flatbed truck (or railcar) and shipped to the owner's location as described above. As many as three 16' long PUMs can fit on a truck thereby minimizing freight costs. For those PUMs wherein the wall and roof sections that are releasably attached to other adjacent sections, it will be appreciated that the entire PUM may be broken down and transported in a collapsed, pre-assembled manner as opposed to a fully assembled PUM. Both configurations have their advantages but such flexibility is desirable versus a unit such a cargo container box that is rigidly fixed together and may not be collapsed down or constructed to easily replace a single wall, floor, or roof section without significantly damaging the structure.

B. Business Method of Use for Delivery and Removal of a PUM

Figure 2:
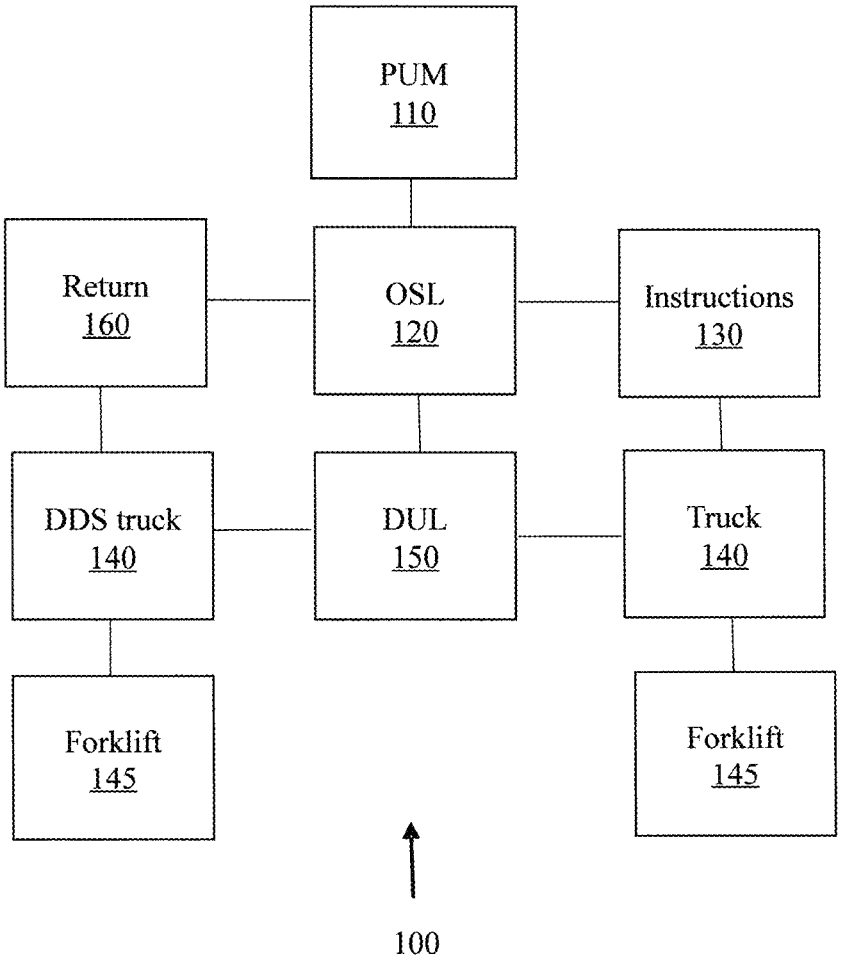
FIG. 2 is a block diagram illustrating how an original storage location (OSL) may deliver and pick up a PUM.

The block diagram in FIG. 2 illustrates one of the many turnkey examples of the unique method of delivery and removal of a typical PUM 110 constructed in accordance with the principles of the present invention, preferably equipped with a command center 55, whereas The PUM is being set up and used at a tailgate party event at a college or professional football game. This particular PUM 110 has been made with amenities 51, 53 suitable for a tailgate party, for example that of PUM 10 described in FIG. 1. PUM 110 is stored by an owner at OSL 120, and based on given instructions 130 (which have been derived from an end user, renter, or other directive). Instructions 130 may be provided in whole or in part through a PUM command center 55 or other communication means. Instructions will typically include a request for delivery, a duration of use or pick-up time, and a pre-selection of inventory, both powered amenities 51 and non-powered amenities 53 that are to be included for delivery and set up at the delivery site. A payment method is also agreed upon where required. In this FIG. 2, PUM 110 is picked up by DDS delivery truck 140 and delivered to the designated DUL 150, which in this case is a parking space at the football stadium. DDS Truck 140 parks adjacent DUL 150, whereas placement is accomplished by forklift 145, which is self-contained on DDS truck 140, off-loaded adjacent DUL 150, and then set securely in place at the DUL 150 parking space. The exact location of DUL 150 may or may not be predetermined based on instructions 130, or upon entry to the football game tailgating event. Either upon delivery, or sometime thereafter, the driver of DDS truck 140 or a user opens the doors and prepares PUM 110 for partying at the tailgate event by setting up any amenities requiring installation, placement, or other set up.

Alternatively, PUM 110 may have been previously prepared at OSL 120 to include various extra items and amenities. This may include signage representing a user's favorite team, an extra refrigerator, or any number of other appurtenances or goods. Likewise, signage or an extra refrigerator could have been brought to the event by a user and posted indoors or outdoors, or plugged in where appropriate. Signage may include any number of promotional sponsors such as a local business, a corporate advertiser, a local fraternity, an alumni or booster organization, and may include posting of any number of message applications, personal or otherwise. The signage may also be used to illustrate sponsorship of an event, and promote certain products or entities, report news events, and so on. Signage may alternately be placed before or after placement of a PUM at a DUL in the interior wall of a front door location (see FIG. 1) and/or in other locations such as the outer walls of sides 12, 14, and 16, or doors 40*a* and 40*b*. All of these instructions may be operated/coordinated in whole or in part through a command center 55 (FIG. 6).

After the tailgate party has ended, and the user no longer desires to use PUM 110, the internal electrical devices are shut down or put in a hibernation mode, the doors closed (may or may not be automatically locked), and arrangement is made for PUM 110 to be returned to OSL 120. If not previously provided, return instructions 160 may be given in any number of means including by phone, email, or other electronic means, at a predesignated time, or through the PUM's command center. Typically DDS truck 140 would have the flexibility of arriving during the game, or a fair amount of time after it ends, when there is the least amount of parking lot congestion. In either case PUM 110 may be quickly located by the driver of the DDS truck 140 though the GPS transmitter housed in the PUM, typically governed by the control center. Upon arrival back to OSL 120, PUM 110 is cleaned, stored, and made ready for a subsequent rental.

The pick-up and delivery of one or more PUMs may also take place over the course of an entire football season, or contractual time period. The key element of the PUM is its versatility and flexibility of use, with the ability to be quickly delivered, dropped off, moved, stored, etc., with a short time period to set-up or close down. It may also include delivery to some other OSL—for example a booster/owner may want it send it to another city for a game taking place the following weekend.

One variation on the delivery, use, and return of a PUM includes units that are completely self-driven, for example in the spirit of a UBER brand vehicle. No DDS truck 140 or driver is required, only the predetermined guidance system of an automated means-motor and controls contained in the PUM—that take it to a DUL and return it as desired. As discussed in FIG. 3 this may also be an inherent part of the potential capabilities and controls in a command center located in the PUM.

C. Method of Rental, Lease, Appropriation of a PUM

Figure 3:
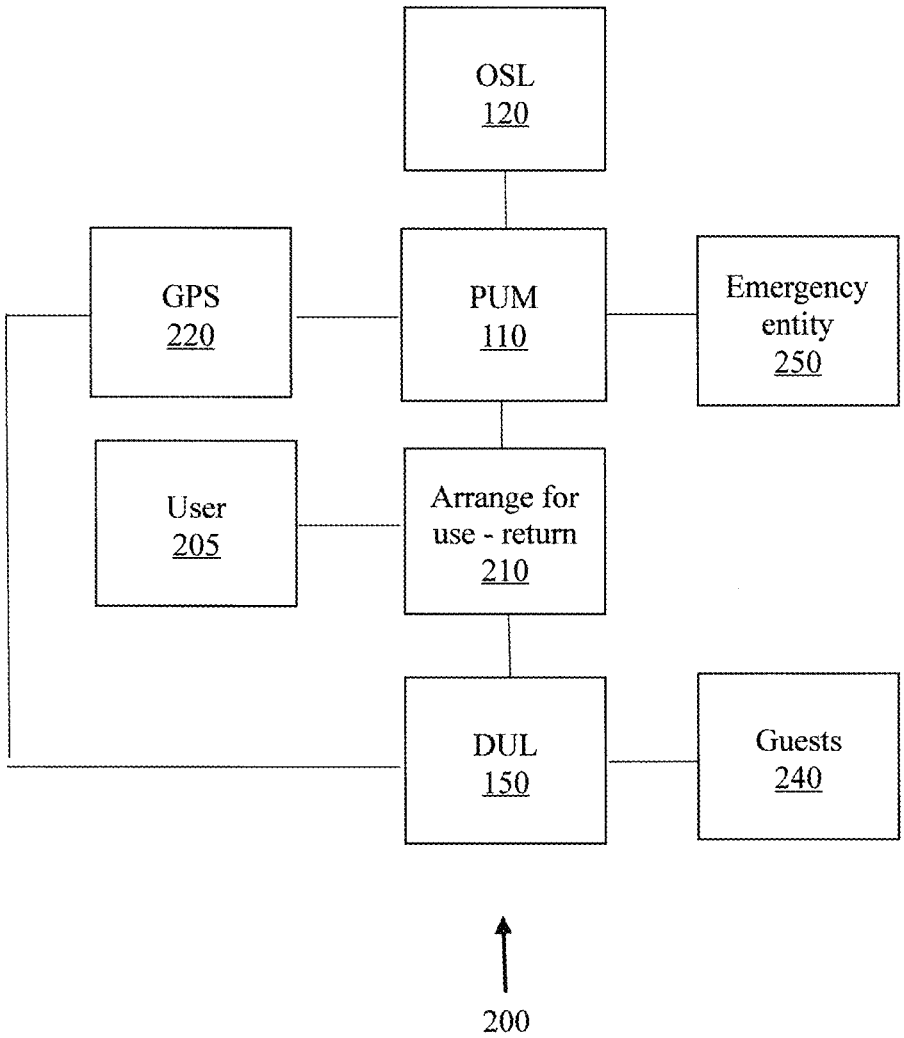
FIG. 3 is a block diagram illustrating how a typical consumer may rent a PUM.

FIG. 3 is representative of PUM 110 being secured (or appropriated) for use 200 by a first user 250, which in this case is a rental, however it may also be for any number of other means to secure for use, such as a lease, permit, purchase, and so on. For simplicity, this one rental method of putting into use is illustrated. A first user 205 secures PUM 110 for use 200 by contacting by phone an owner or authorized employee or agent who has PUM 110 in storage at its OSL 120 and makes arrangements 210 are made for PUM 110 to be rented for a certain time period and delivered to a DUL 150 at a predetermined time thereby commencing the rental period. During this delivery time period, first user 205 may optionally track PUM 110 in route via GPS 220 located in the PUM, and know when and where the driver of DDS truck 140 (see FIG. 2) placed it for set up and usage. Or, it may optionally be set up for usage by first user 205.

Putting PUM 110 into use typically means it has been placed in the predesignated, authorized DUL, the door(s) have been unlocked, electricity has been connected (if applicable), and PUM 110 is ready to receive guests 240. Thus, it is now operable by first user 205 who can control various aspects of use such as lighting, heating/cooling, TV or monitor use, music and so on, which may be done manually or remotely through command center 240, or with each appurtenance individually. Command center 240 may be optionally controlled by device 250 such as first user's, or a subsequent user's smart phone, tablet, laptop, etc. as will be described in FIG. 4A.

When PUM 110 has been set-up and put into use, GPS 220 may continue to emit its location-finding signal thereby allowing guests 240 to more easily locate PUM 110 via smartphone when arriving at the event, whereas they may become additional users. This GPS operation can be of particular value in any number of high volume, crowded locations, for example locating a PUM at a tailgate party in a large stadium parking lot, a tradeshow booth at a convention center with 1000+ booths, a birthday party PUM in a large public park, and so on.

The GPS feature may also be valuable for many commercial purposes for example, locating a PUM being used for training purposes, medical and community services, etc. Furthermore, GPS 220 serves as a unique means of tracking usage and location-finding for security purposes. This may include location of a stolen PUM, or perhaps put into use by a command center that connects to an emergency signaling entity 250 such as a satellite link commonly used with automobiles when they require roadside assistance.

Again, the methods of securing for use by a first user 205 and subsequent guests 240 may be appropriated by authorized entities in the form of owners, lessees, sub-lessees, and so on. A first user's ability to initiate the start-up of a PUM may be accomplished purely by remote means, for example from the OSL, or from some other form of remote device that operates the Command center. This may be desirable when a PUM is used to primarily to receive guests (or customers) such as at a stadium event, or for use as a public service in a general locale.

It also goes without saying that the set-up and usage of a PUM may include the appropriation of an entire village of units (FIG. 11), 20, 30 or more for more multiple guests and subsequent users, casual, invitees, or otherwise. The means of initiating the delivery and usage of PUMs and the means of putting into use has substantial flexibility depending on the time frame the PUM will be used, and ultimately when it is closed down and subsequently reused. The time period may be a single afternoon for a party, an entire football season, or for the entire ownership of a PUM being delivered to a more or less permanent site. This would be a desirable application for public service applications such as rest stops, medical relief, or as a personal habitat placed at a DUL in a forested remote mountain top property.

As always, when the usage of a PUM has terminated, the PUM is returned to the OSL by a DDS truck picking the PUM up and delivering the PUM back to the original OSL (FIG. 2) or onward to a second OSL site. It is interesting to note that if the driver of a DDS truck coming from an OSL 110 is a different driver than the one who delivered the PUM, the new driver may quickly locate the PUM by tracking it location via GPS 220. This saves time and assures the correct unit is being picked up for return to the OSL or to a next OSL location per instructions 210. In the event of self-driven PUMs, remote initiation of the return would be arranged or prearranged by its owner/lessee/sub lessee, a user or other authorized individual.

D. Method of User Use and Operation

Figure 4A:
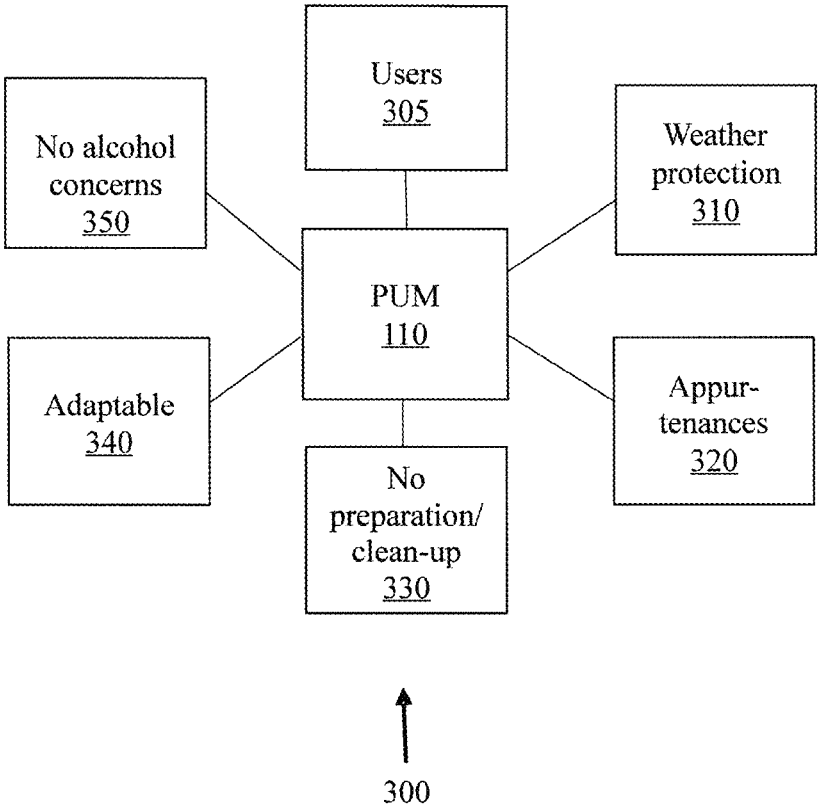
FIGS. 4A and 4B are block diagrams illustrating how a user may use and operate a PUM.

As previously disclosed, FIG. 4A also illustrates a PUM used at an event such as a football game tailgate party. The many advantages of using a PUM by a user are significant, starting with the ease of acquirement as previous cited in FIG. 3 that eliminates the need to have an RV or other vehicle that requires a driver's license. For users 305 (a first user and other guests/users/participants) its use 300 provides protection against the weather and elements 310; a breadth of comfort associated with home-type appurtenances 320 such as seating, TVs, air conditioning and heating, even a serviceable bar with glasses, plates, etc. There are no time-consuming preparations in advance nor time-consuming clean-up after use 330. Without an elevated foundation, it easily adapts to wheelchairs and the elderly 340. Without a need to drive the PUM upon delivery or return, there is no concern about alcohol consumption 350. Perhaps most important, it is far more cost-effective than buying or renting an RV or trailer. Essentially it is a turnkey operation for a user's use as a temporary habitat, facility, booth, or for the multiple alternative purposes described herein.

Figure 4B:
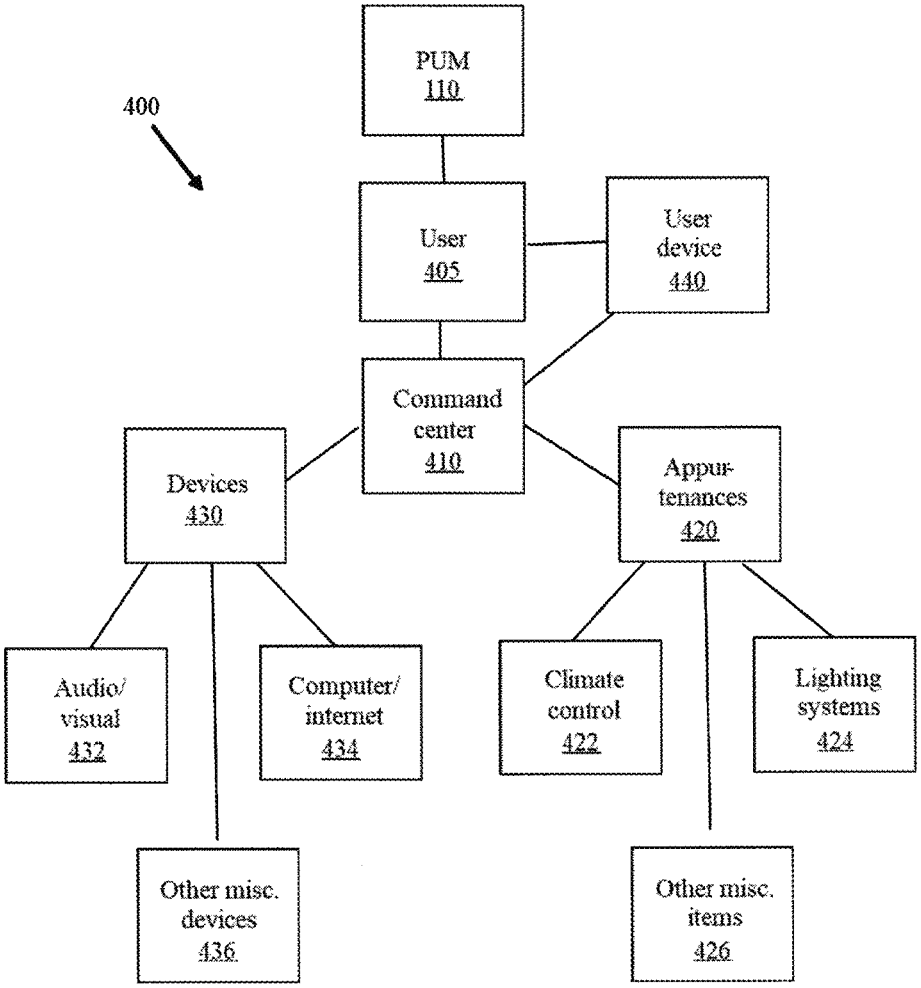

In FIG. 4B internal operations 400 of PUM 110 that has been delivered to its DUL is controlled by a user 405. Ideally, but not mandatory, it may be controlled and operated through the command center 410. In this instance, command center 410 controls numerous peripheral appurtenances 420 and devices 430. Amenities or appurtenances 420 may include climate control applications 422, such as heating, air conditioning, humidifier, a front door air blowdown system or front door(s) screen to maintain the internal temperature; lighting systems 424, such built-in or free standing lamps, external lighting, etc., refrigerators and refrigeration, cooking and food preparation stoves and overs, and; other miscellaneous items 426, such as an outdoor awning, insect zappers, aroma control, and so on.

User 400 may also control a number of devices 430 (a subset of the amenities), for example operation of audio/visual devices 432 such as TV screens or monitors and their related computer programs and their related graphics, slide-shows, and videos, and may include the control of music choice and volume. Devices may also include computer and internet related services 434 such as accessing music play-lists (for example through Amazon Prime or Pandora), the retrieval of emails, the retrieval of documents, presentations that may be stored on the cloud, even a user's guide for operation of a PUM, and on and on. Miscellaneous other devices 436 may also be accessed by user 400 through the Control center. It is the preference of the present invention that these various usages and activities may be controlled by a user either by direct interface with the Control (command) center 410, or through a connection to a user's device 440. This is typically accomplished through using an application installed on user device 440, which may be a smart phone, tablet, laptop, smart watch, and so on, with the connection made by Bluetooth, Wi-Fi, even a cable such as a USB cord. It may also be made directly to any one or more network devices and appurtenances such as with a Sonos® speaker system. All said, the number of appurtenances 420 and devices 430, or user devices 440 listed herein is not intended to be limited to those discussed in this example. A PUM used for tradeshows, a party at a local park, or a commercial enterprise for instance, may have different appurtenances and devices for their purposes.

Figure 5:
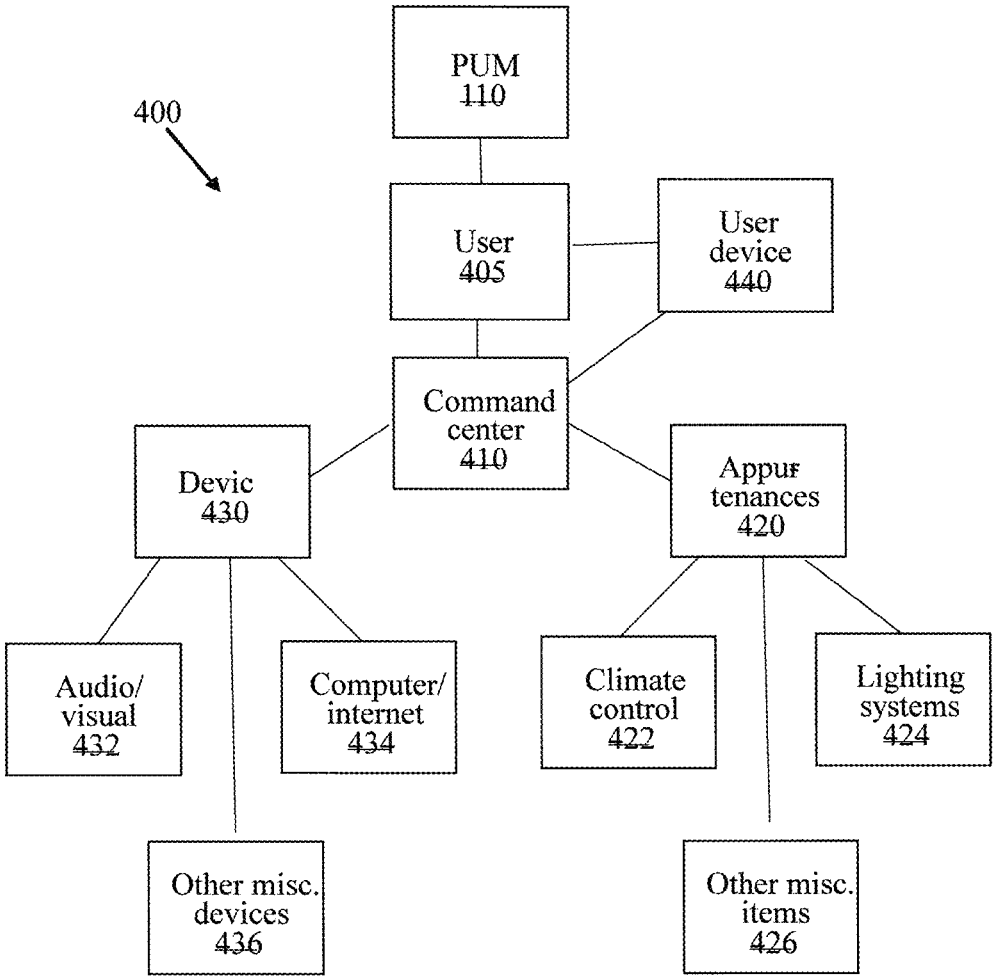
FIG. 5 is a block diagram illustrating methodologies of a typical use and operation by a PUM owner, lessee, or sub-lessee.

E. Methods of Use and Operation by a PUM Owner, Lessee, or Sub-Lessee Enterprise In FIG. 5, multiple PUMs are used and operated as an enterprise 500 by operator 505 (owner, lessee, or sub-lessee enterprise) who has set-up a small village 510 (also, for example PUMs 510*a-d* in FIG. 11) consisting of ten PUMs, all of which have been opened, set-up and put into use. In this particular application operator 500 has several options 520 of allowing guests 530 to use one or more PUMs in the village.

To further clarify relationships, a PUM operator 500 may be the outright owner of the PUM, a renter, lessee, sub-lessee, a donation recipient, or an authorized employee of same. A PUM operator may be engaged in several optional uses 520, for example, a profit-related enterprise 540 (charging admission, fund raising, alumni support, etc.), and a not-for-profit enterprise 550. Profit oriented enterprises may include commercial services 542 and indirectly profitable promotional services 544. A not for profit service 550, may include a public service entity supported by local or regional municipal/state taxes 552, or non-profit fund-raising for a public or private enterprise 554, and may include other enterprising motives 560. The flexibility of the use of portable PUMs broadens its capability to be used in sporting events by universities, alumni associations, stadium owners, sports club supporters, game attendees, local businesses, etc., all of which may be for profit or non-profit purposes. Universities may also use them for any number of events as a means to attract participants, offer local services, and so on.

F. Variations

Referring now to FIGS. 8A-8D, wherein in like components may be like numbered and features of the PUM 10, 110 described above may be incorporated herewith, an alternative PUM 510 constructed in accordance with the principles of the present invention is illustrated with an upper deck configuration. In this exemplary embodiment, a lowermost section, generally designated 511 and an upper deck section, generally designated 513, connected by a set of stairs, generally designated 515.

Figure 8A:
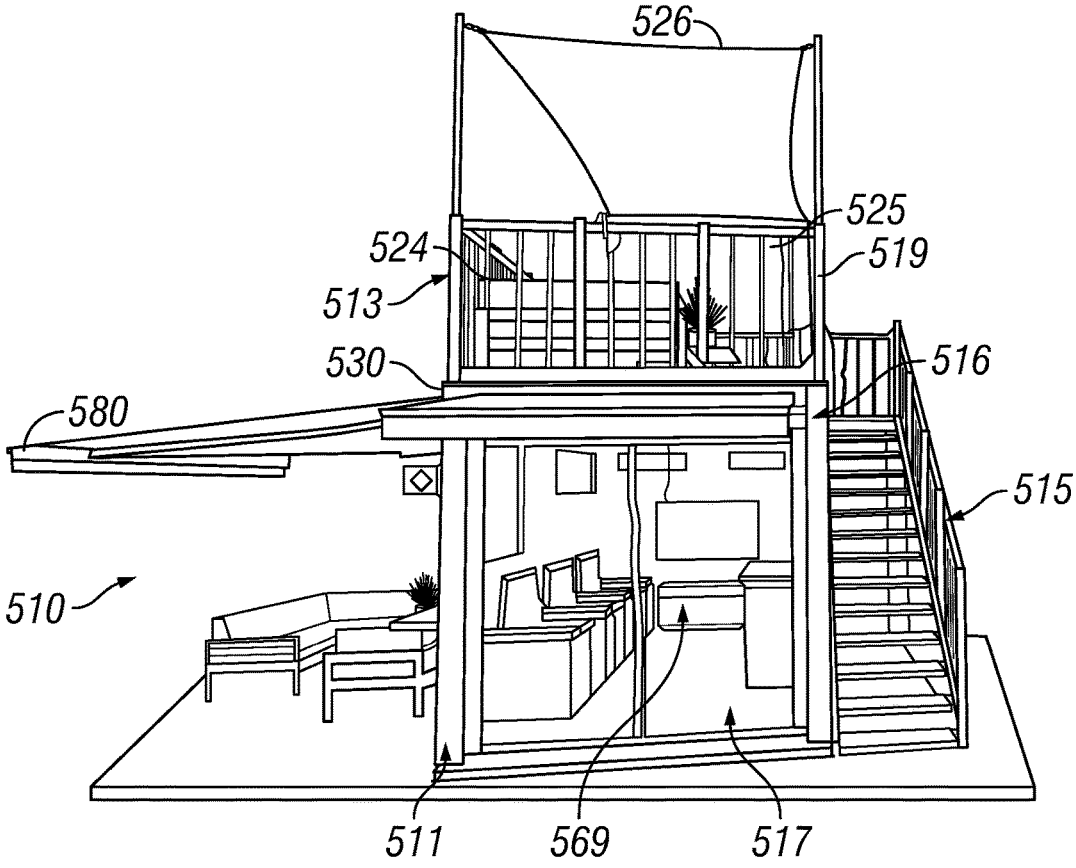
FIG. 8A is a front view of an alternative PUM embodiment constructed in accordance with the principles of the present invention illustrating an upper deck and stairway configuration.
Figure 8B:
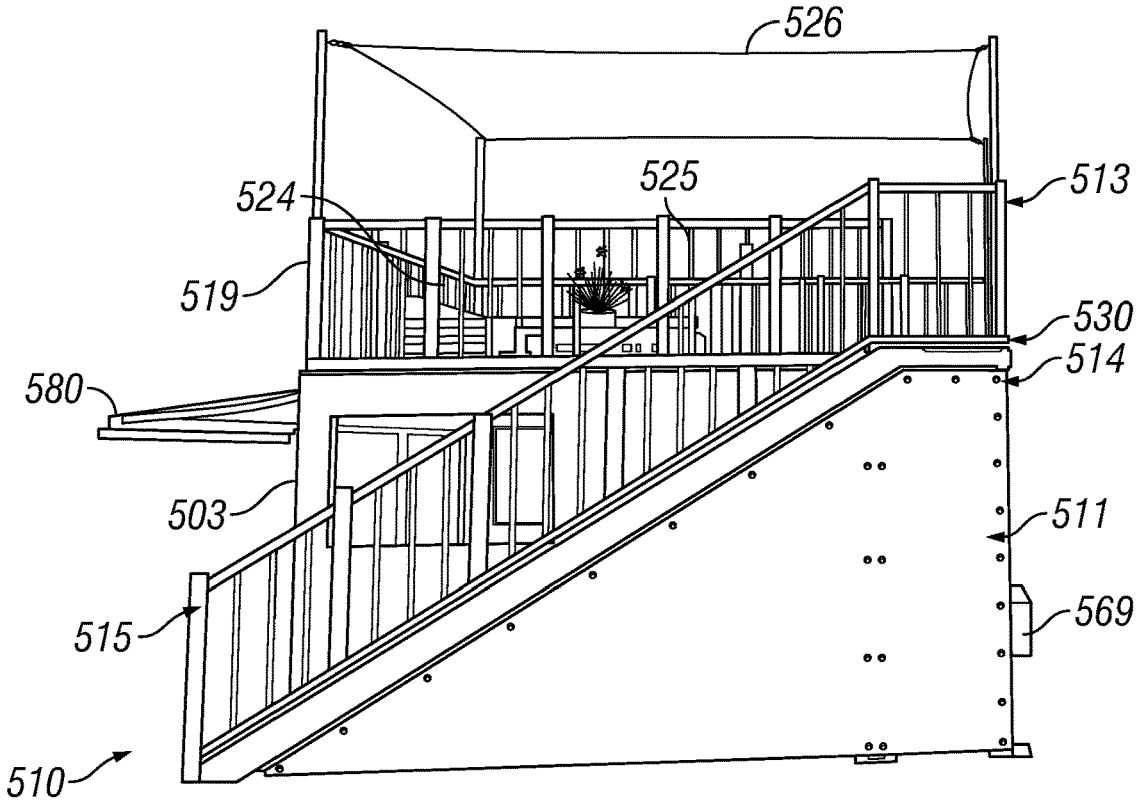
FIG. 8B is a right side view of the PUM of FIG. 8A.

As best shown in FIG. 8A, the lower section (or downstairs) 511 includes a set of sliding glass doors 540*a*, 540*b* instead of solid panel doors as in the PUM 10 described above. Such doors may be used to close off an interior space 517 in the lower section allowing for improved climate controls using climate control device 569 (FIGS. 8A-8C) such as a heater, air conditioning, fan, or a combination thereof. This is direct contrast to those upcycled cargo container units which are typically open on three sides or maintain their cargo doors in an open configuration with a large opening in the sidewall as well. Such other container construtions do not provide a sealable interior space.

Figure 8C:
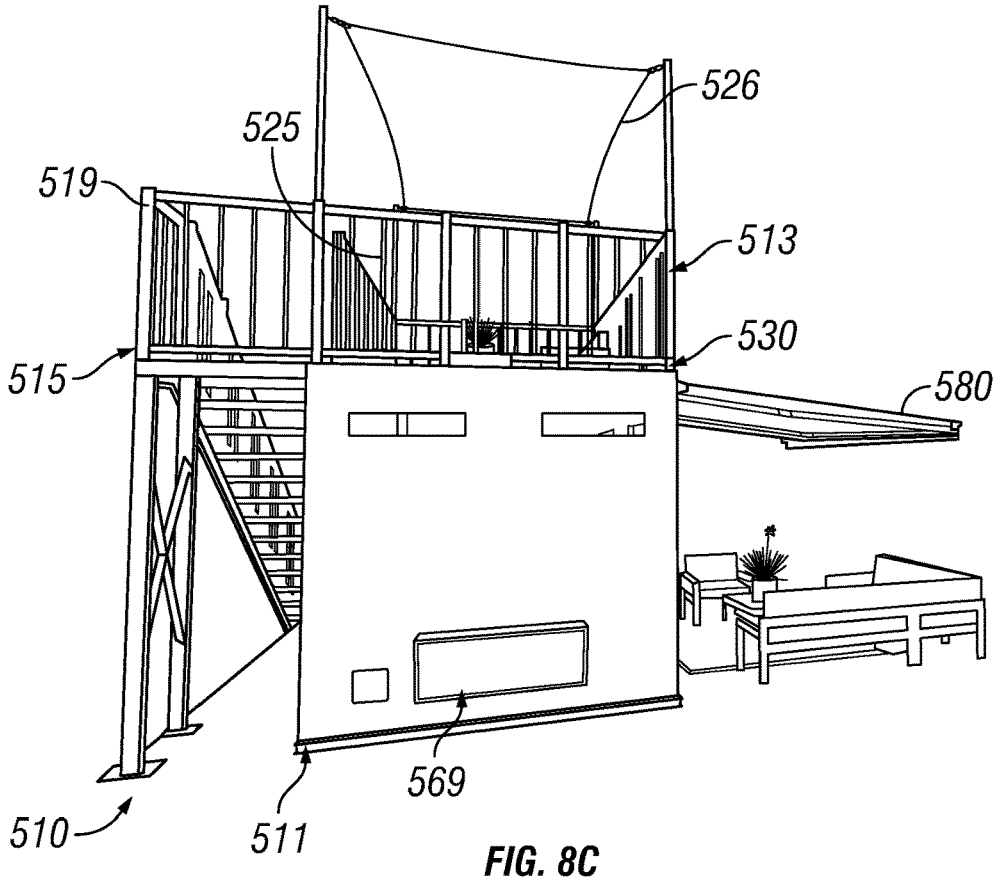
FIG. 8C is a rear view of the PUM of FIG. 8A.
Figure 8D:
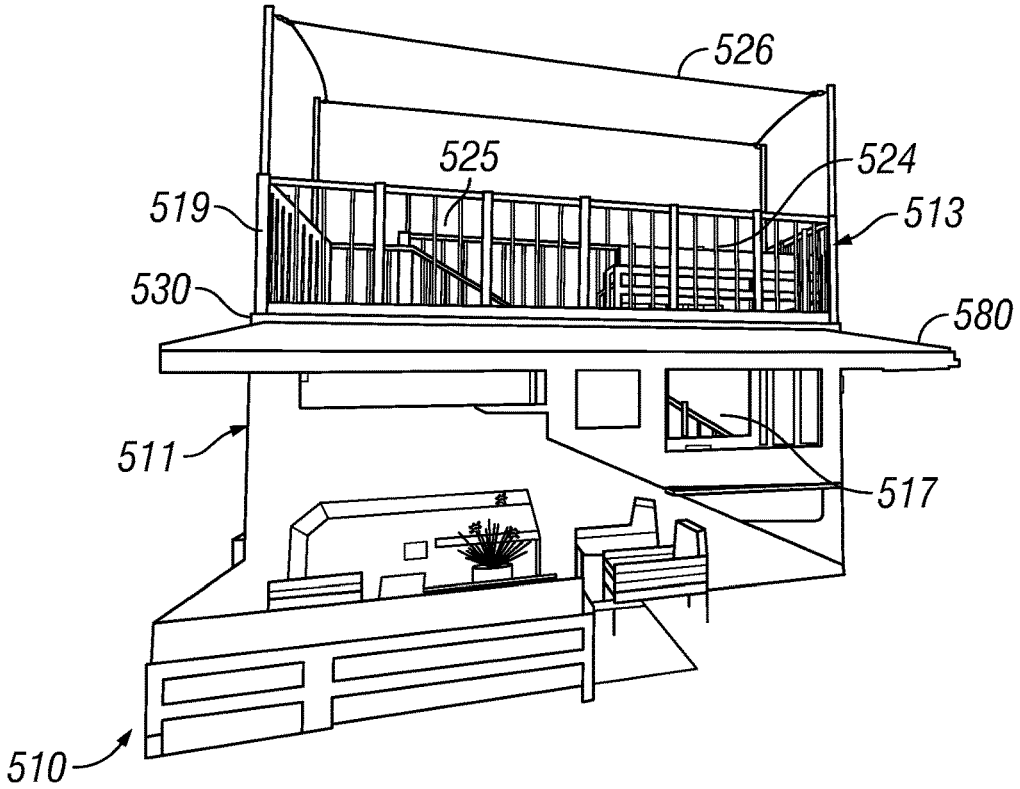
FIG. 8D is a left side view of the PUM of FIG. 8A.

As shown in FIGS. 8A and 8C-8D, the personal use space, typically defined as the interior 517 of the PUM may be extended outside the footprint of the PUM as indicated by the area beneath the extended awning 580 wherein additional amenities such as a seating area may be set up.

Referring now to FIG. 8A-8D, the upper deck section 513 includes a railing 519 which defines a viewing area 523 that may include amenities such as couches and chairs placed in a seating area 524 as well as an adjacent standing area 525. An auxiliary awning 526 is supported by a set of four support poles at each corner of the upper deck section. To reach the upper deck section, the staircase 515 abuts the right side 516 of the PUM 510 and is generally the same length of the right side of the PUM spanning approximately from the front side 503 to the rear side 514 of the PUM. In this exemplary embodiment, the stairs includes a short landing adjacent to and flush with the floor of the upper deck, which is typically the same of the upper surface of the roof 530. The stairs are releasably secured to the main structural body of the PUM and may be removed and stored inside or alongside the main structural body of the PUM during transport.

Delivery and use of such PUM 510 is similar to that described above for the PUM 10 (FIGS. 1A-1H and 6) and PUM 110 (FIGS. 2-5). A preferred non-limiting footprint useful for a large variety of venues and events has been found to be 20'×20' with a capacity of around 50 people. Whether stacking multiple PUMs or providing an upper deck, the lower unit and roof may be constructed to withstand a pre-determined weight load placed thereon.

In tradeshow applications the uses may be controlled by convention centers, tradeshow sponsors, tradeshow group supporters, tradeshow participants, a local union, and so on. PUMs provide a very attractive turnkey operation for many tradeshow applications. Whether any one of these applications is related to charging admission, or some other means of open, public usage, the principles remain the same, that is, a quick, inexpensive way to acquire and put into use, a portable tradeshow booth module with creature comforts.

Figure 9:
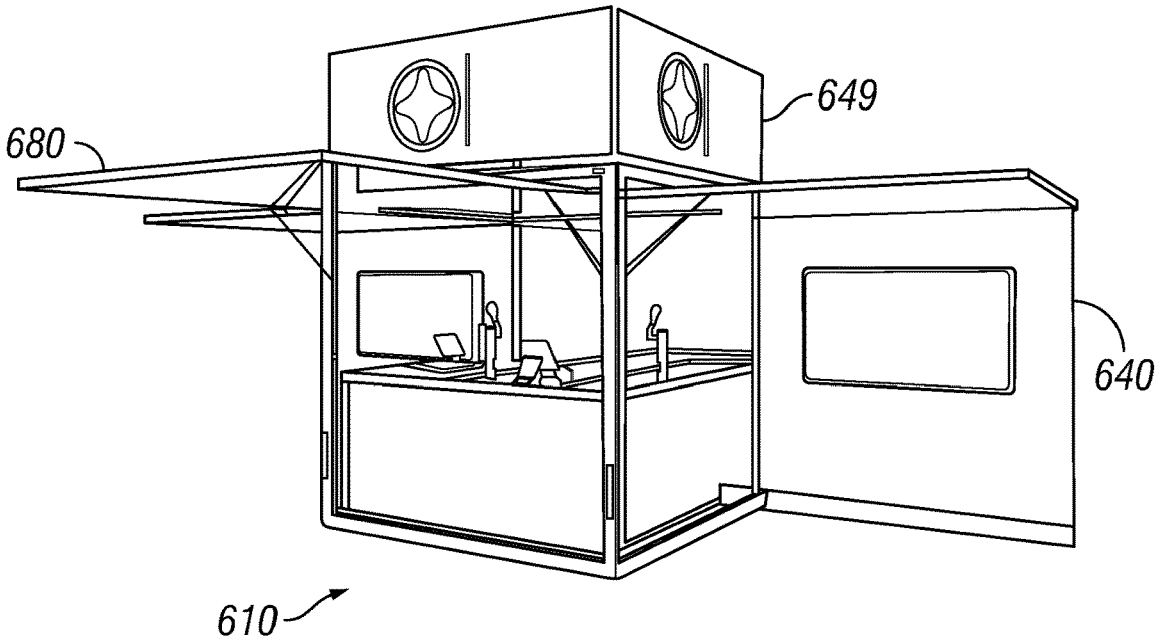
FIG. 9 is a perspective view of another alternative PUM constructed in accordance with the principles of the present invention.

While the above PUMs typically aim for a higher capacity, a smaller trade show or porta-bar PUM variation is also contemplated herein. Referring now to FIG. 9, wherein like components may be like numbered and features disclosed elsewhere herein may be incorporated in this example as well, such an exemplary trade show PUM variation 610 is shown. In addition to a smaller footprint, this PUM 610 focuses more of the promotional advantages of the PUM. As shown in FIG. 9, the PUM includes a swing out door 640 and extendable awning 680 with the main section providing an office-like or cube-like space from which a user may display the company's promotional items, marque signage, or other branding items. An enlarged upper section 649 provides additional space for company logos and other signage to attract attention from afar. Electronic devices may be releasably secured about the PUM wall surfaces as well. Amenities such as a bar area, fridge, and integrated CO2 tap system may be provided as well in the porta-bar version. An exemplary preferred but non-limiting footprint for trade show events has been found to be 24'×16'.

Figure 10:
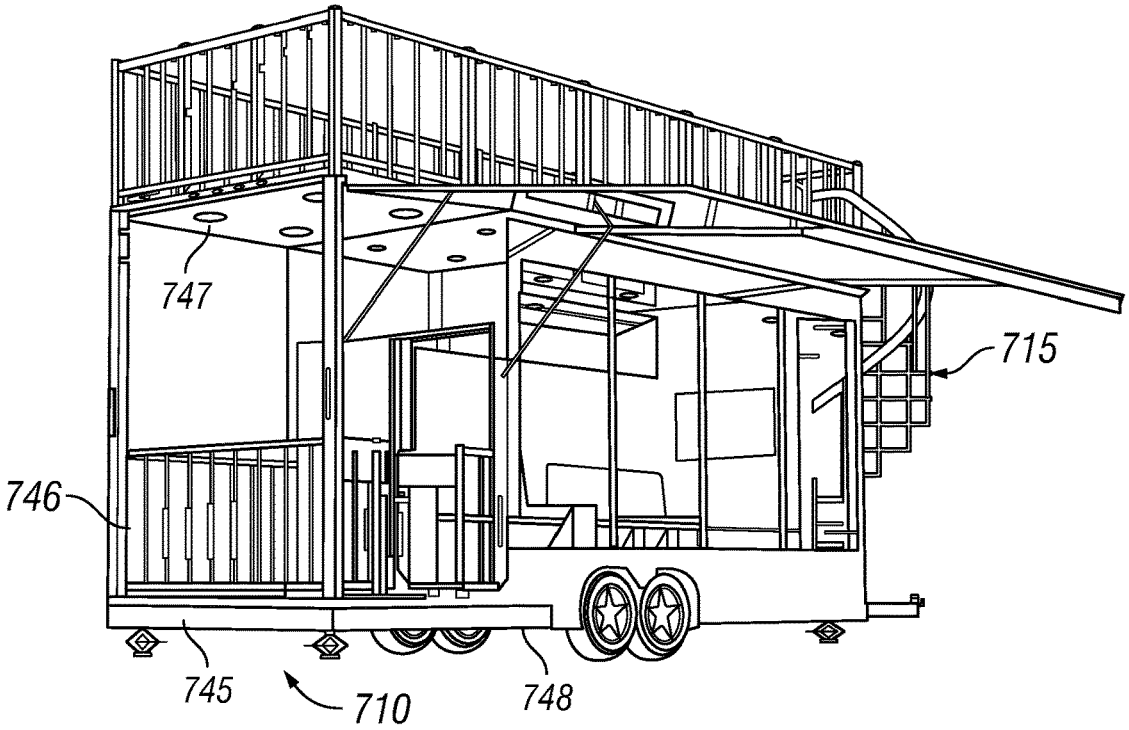
FIG. 10 is a perspective view of another alternative PUM constructed in accordance with the principles of the present invention illustrating a PUM mounted on a wheeled platform.

Larger suites are also contemplated as well. Referring now to FIG. 10, wherein like components may be like numbered and features described above may be incorporated into this style of PUM as well, a PUM variation 710 is illustrated. In general, the structure of the PUM 710 of FIG. 10 is similar to that shown in FIGS. 8A-D except with a larger footprint, a spiral staircase 715, and an extended front deck or porch portion 745 with a guard rail 746. A complementary upper deck extension 747 is provided as well. In addition, the PUM 710 shown in this exemplary embodiment is mounted atop a wheeled trailer 748 and may be towed to a designated use location (DUL) instead of riding atop a flatbed trailer 87 (FIG. 7). The suite pictured in FIG. 10 is constructed to handle a capacity of around 65 people with a space requirement of around 30'×20'. The PUM may be integrally built atop or into the wheeled trailer and remain on the trailer during use or incorporate a frame 90 along the lines described for PUM 10 above and merely placed atop the wheeled trailer for transport and offloaded and placed using a forklift as described above.

Figure 11:
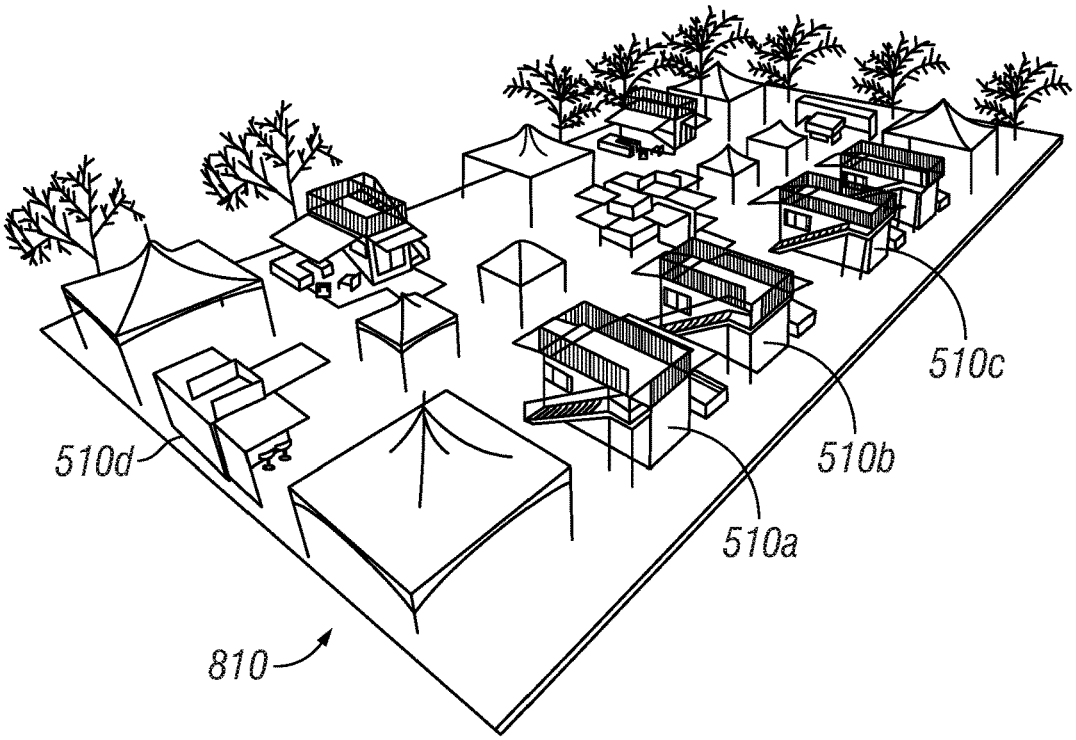
FIG. 11 is a perspective view of a PUM village illustrating a cluster of PUMs.

As an example of the versatility of the PUMs, as shown in FIG. 11, wherein in like components are like numbered, entire villages 810 of PUMs 510*a*, 510*b*, 510*c*, and 510*d*, for example, may be set up side by side before a football game (or other event) may include fencing, cordoning, or otherwise sectioning off a section for privacy, the incorporation of additional portable storage units for goods used and perhaps sold in the village, perhaps even a toilet and first aid center. In a tradeshow, entire villages of like-products can be set up and also cordoned off to indicate the exhibitors are from a common organization, or in the same industry. In this example, PUMs 510*a-c* are the same or similar while PUM 510*d* if of a different construction and open configuration illustrating the versatility of a PUM village setup.

As illustrated in FIG. 11 any one or more of the PUMs in a village may include awnings, two-, or three-story abilities (for example, this would be of great value at a PGA golf tournament), openable sides, sunroofs, etc., all of which units are portable, easily stackable, and may be maneuvered by a forklift or other system such as the remote controlled mule or other remote controlled transport or autopilot transport system.

It can be seen that the unique user methodologies associated with PUMs includes a myriad of other personal and commercial uses: a hospitality room; a house party; a temporary flu-shot clinic or x-ray facility; a mountain retreat; a training facility, and so on. In any given use, the PUM would be suitably designed, engineered, and manufactured with amenities and accoutrements to accompany the intended use. For example, a fun house for house parties, shielding for x-rays, bedding for a mountain retreat, etc. would all require different forms of appurtenances. There no intention to limit the potential personal and commercial uses, but instead to offer an expanding, endless list. A modular construction with removable wall sections facilitates alternative constructions better than a permanently fixed and welded structure. However, both constructions fall within the scope of invention as defined in the appended claims. In addition, while the PUMs disclosed herein generally have an efficient hexagonal shape, this is not meant to be limiting, and other suitable module shapes may be used.

As cited throughout, the spirit of the present invention provides a breadth of scope that includes all methods of uses as cited herein. Any variation on the theme and methodology of accomplishing the same that are not described herein would be considered under the scope of the present invention.

Certain objects and advantages of the invention are described herein. These and other objects of the invention, as well as many of the intended advantages thereof, will become more readily apparent when reference is made to the accompanying description taken in conjunction with the accompanying figures with the understanding that the embodiments described herein may satisfy one or more of the objectives. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. A portable personal use module comprising:

a pre-assembled portable structural unit including a support base framework section with at least one set of spaced apart forklift receiving slots, a set of upright wall sections projecting upwardly from the support base framework section with at least one upright wall section defining at least one entryway, and a roof section mounted atop the upright wall sections, the sections cooperating to define an interior space accessible through the entryway;

a set of inventory items selected to customize at least a portion of the interior space of the portable structural unit prior to the transport of the portable structural unit from an initial location to a designated usage location based on a rental use transaction for a pre-determined time interval, the set of inventory items including a powered suite of electrically powered devices with at least one electrically powered device requiring an electrical power source and having a unique powered device ID associated with at least one electronic-based control restriction releasable upon receipt of an electronic access control code, the set of inventory items further including a non-powered suite of amenities with at least one amenity having a unique amenity ID associated with at least one physical access restriction releasable upon receipt of a physical access control code;

at least one connector constructed to place the suite of electrically powered devices in electrical communication with at least one electrical power source; and a command center in communication with the electronic-based control restriction of the at least one electrically powered device from the powered suite and operable to selectively transmit the electronic access control code to release the electronic-based control restriction of the at least one electrically powered device at the designated usage location enabling control of the at least one electrically powered device, the command center further being operable to selectively transmit the physical access control code to remove the physical access restriction of the at least one amenity enabling physical access to the at least one amenity.

2. The module of claim 1 wherein:

the support base framework section includes at least two sets of spaced apart forklift slots located along adjacent sides of the support frame section.

3. The module of claim 1 wherein:

the suite of powered devices includes a climate control device constructed to control the environment within the interior space of the portable structural unit.

4. The module of claim 1 wherein:

the command center is operable to remotely remove the control restriction of the at least one powered device at the designated usage location.

5. The module of claim 1 wherein:

the powered device is selected from one of: a refrigerator, a door lock, a display device, a secure storage access panel, at least one light source, an electronic display, or a multi-media station.

6. The module of claim 1 wherein:

access through the entryway is controlled by a sliding door.

7. The module of claim 1 further comprising:

a set of stairs transportable with the portable structural unit is provided and, when set up, leads from a ground floor to the top of the roof section.

8. The module of claim 7 further comprising:

an upper deck section atop the roof section to provide a viewing station and constructed to support a pre-determined weight load and including a seating area.

9. The module of claim 1 further comprising:

an awning extendable from the roof or upright wall sections.

10. The module of claim 1 wherein:

the portable structural unit and the selected set of inventory items are transportable together on a flatbed trailer from the initial location proximate the designated usage location and constructed to be lifted off and placed into the designated usage location using a forklift with a set of forklift tines inserted into the forklift slots of the support base framework section.

11. The module of claim 1 further comprising:

a power source constructed to selectively energize the at least one powered device upon removal of the associated electronic-based control restriction.

12. The module of claim 1 wherein:

the portable structural unit is constructed to stack atop the roof section of another portable structural unit.

13. The module of claim 1 further comprising:

a GPS transmitter constructed to transmit the current location of the portable structural unit.

14. The module of claim 1 further comprising:

an alarm system in communication with the command center.

15. The module of claim 1 wherein:

the sections are fabricated with at least one upright wall section including a door and at least one upright wall section including a window.

* * * * *